US006553124B2

(12) United States Patent
Azima et al.

(10) Patent No.: US 6,553,124 B2
(45) **Date of Patent: *Apr. 22, 2003**

(54) ACOUSTIC DEVICE

(75) Inventors: Henry Azima, Cambridge (GB); Joerg Panzer, Huntingdon (GB)

(73) Assignee: New Transducers Limited, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/287,109

(22) Filed: Apr. 7, 1999

(65) Prior Publication Data

US 2002/0114483 A1 Aug. 22, 2002

Related U.S. Application Data

(63) Continuation-in-part of application No. 08/707,012, filed on Sep. 3, 1996, now Pat. No. 6,332,029.

(30) Foreign Application Priority Data

| | | |
|---|---|---|
| Sep. 2, 1995 | (GB) | 9517918 |
| Oct. 31, 1995 | (GB) | 9522281 |
| Mar. 30, 1996 | (GB) | 9606836 |
| Apr. 7, 1998 | (GB) | 9807316 |

(51) Int. Cl.[7] ..... H04R 25/00

(52) U.S. Cl. ..... 381/345; 381/431

(58) Field of Search ..... 381/150, 152, 381/162, 173, 190, 191, 345, 386, 392, 396, 417, 431; 181/149, 199

(56) References Cited

U.S. PATENT DOCUMENTS

| | | | | | |
|---|---|---|---|---|---|
| 3,509,282 | A | * | 4/1970 | Ashworth | 381/152 |
| 4,506,117 | A | * | 3/1985 | Fresard | 381/412 |
| 4,928,312 | A | * | 5/1990 | Hill | 381/431 |
| 5,670,932 | A | * | 9/1997 | Kizima | 381/190 |
| 5,761,324 | A | * | 6/1998 | Kanai et al. | 381/190 |
| 6,332,029 | B1 | * | 12/2001 | Azima et al. | 381/152 |

FOREIGN PATENT DOCUMENTS

| | | |
|---|---|---|
| WO | WO 97/09842 A2 | 3/1997 |

* cited by examiner

*Primary Examiner*—Curtis Kuntz
*Assistant Examiner*—Suhan Ni
(74) *Attorney, Agent, or Firm*—Foley & Lardner

(57) ABSTRACT

An acoustic device, e.g. a loudspeaker, comprising a resonant multi-mode acoustic radiator panel having opposed faces, a vibration exciter arranged to apply bending wave vibration to the resonant panel to produce an acoustic output, a cavity enclosing at least a portion of one panel face and arranged to contain acoustic radiation from the portion of the panel face, wherein the cavity is such as to modify the modal behaviour of the panel.

Also disclosed is a method of modifying the modal behaviour of a resonant panel acoustic device, comprising bringing the resonant panel into close proximity with a boundary surface to define a resonant cavity therebetween.

7 Claims, 23 Drawing Sheets

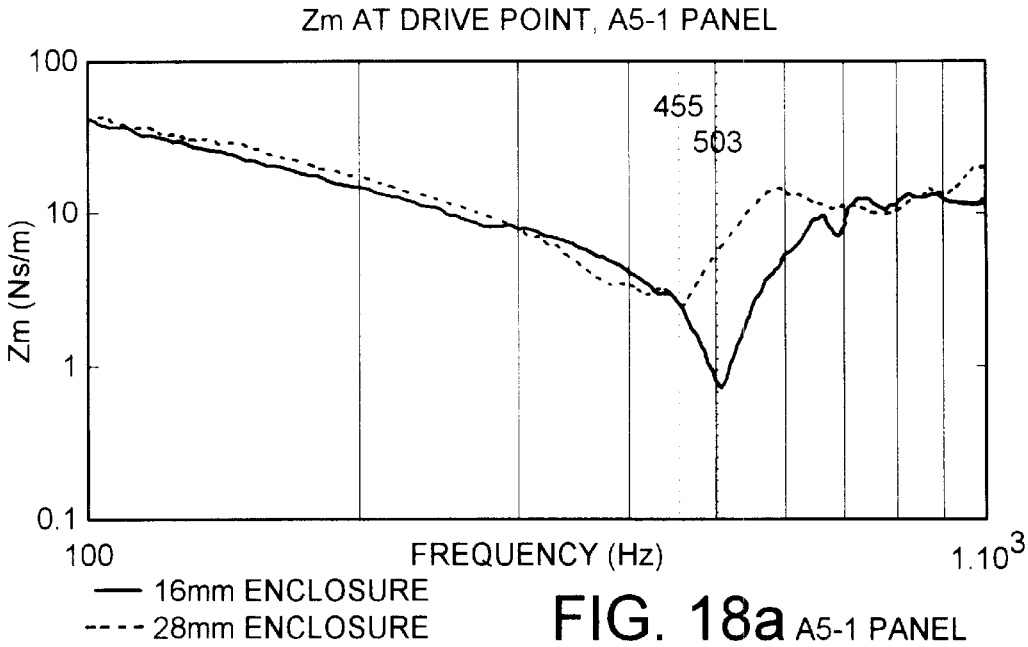
FIG. 18a A5-1 PANEL
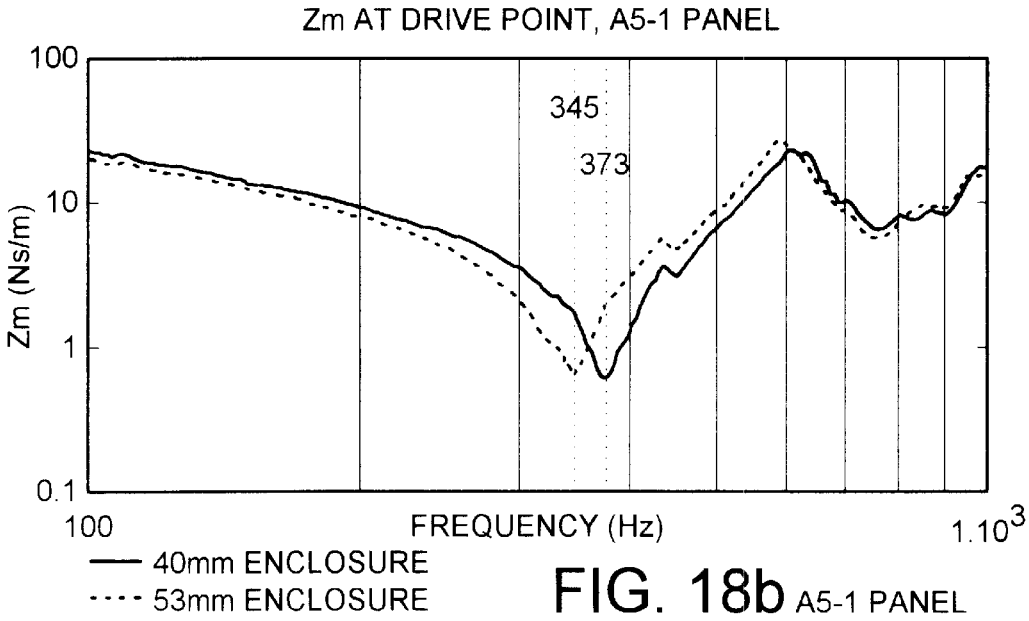
FIG. 18b A5-1 PANEL

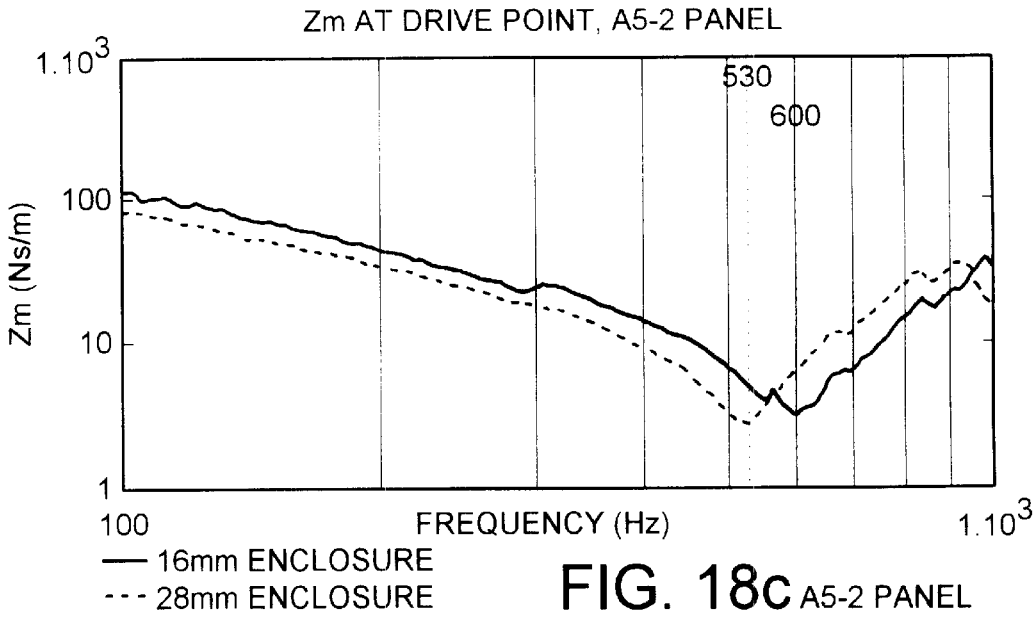
FIG. 18c A5-2 PANEL
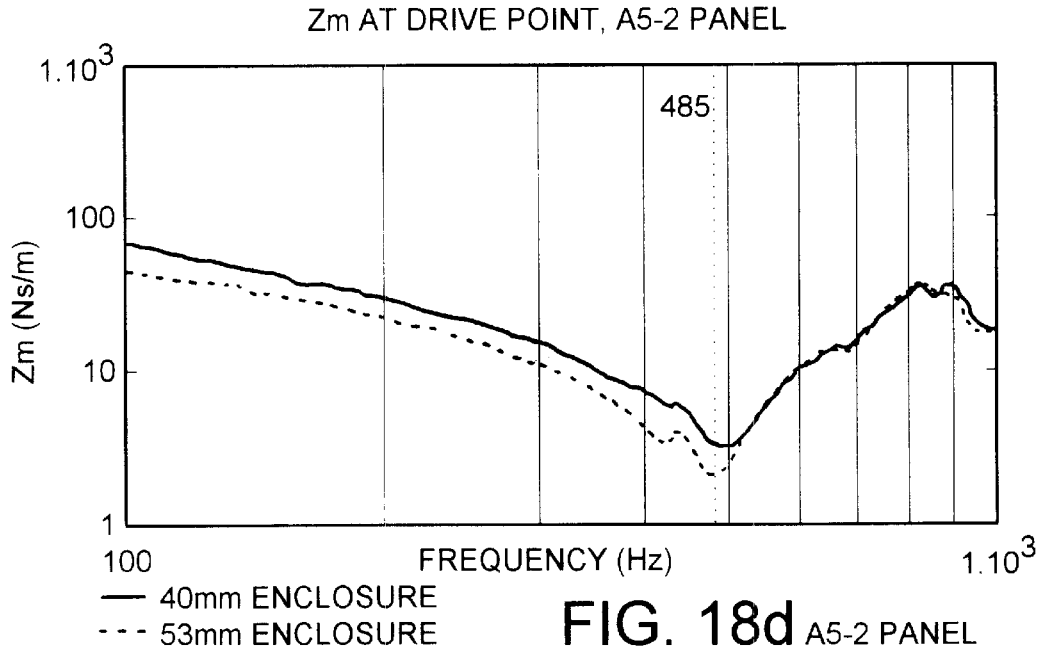
FIG. 18d A5-2 PANEL

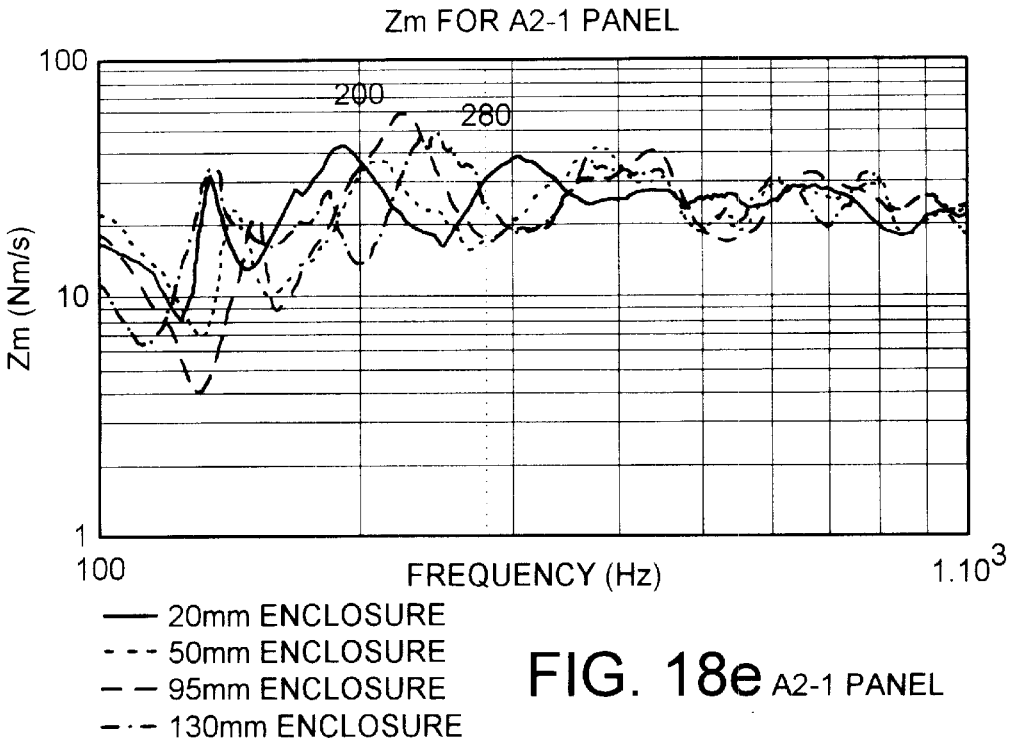
FIG. 18e A2-1 PANEL
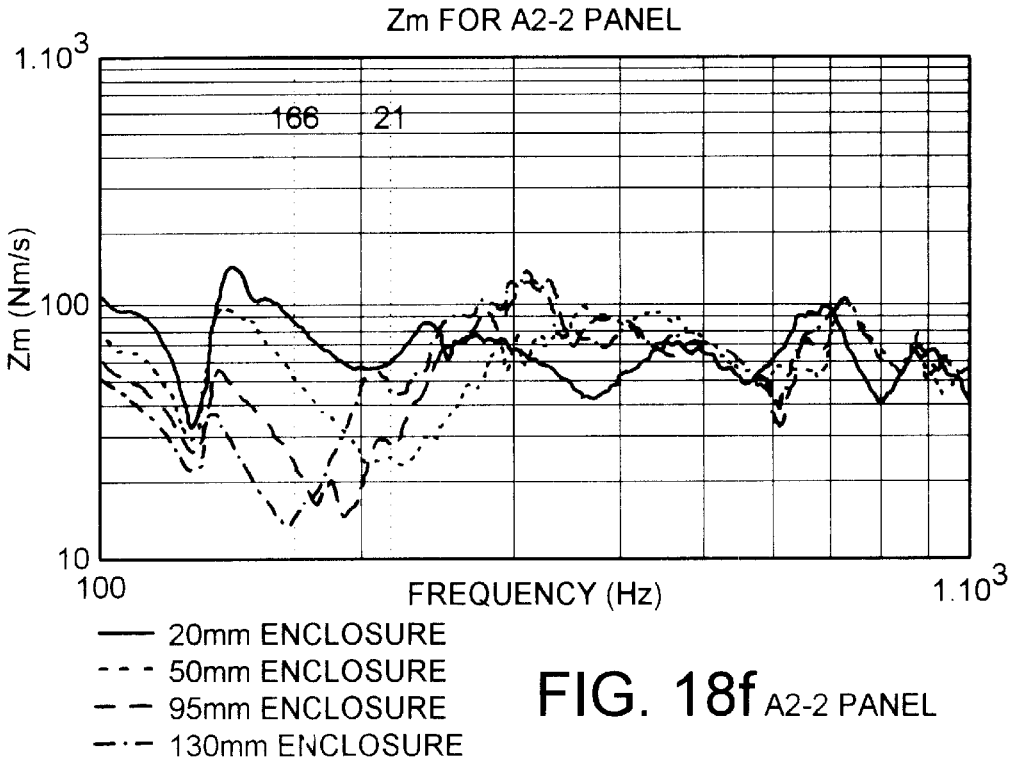
FIG. 18f A2-2 PANEL

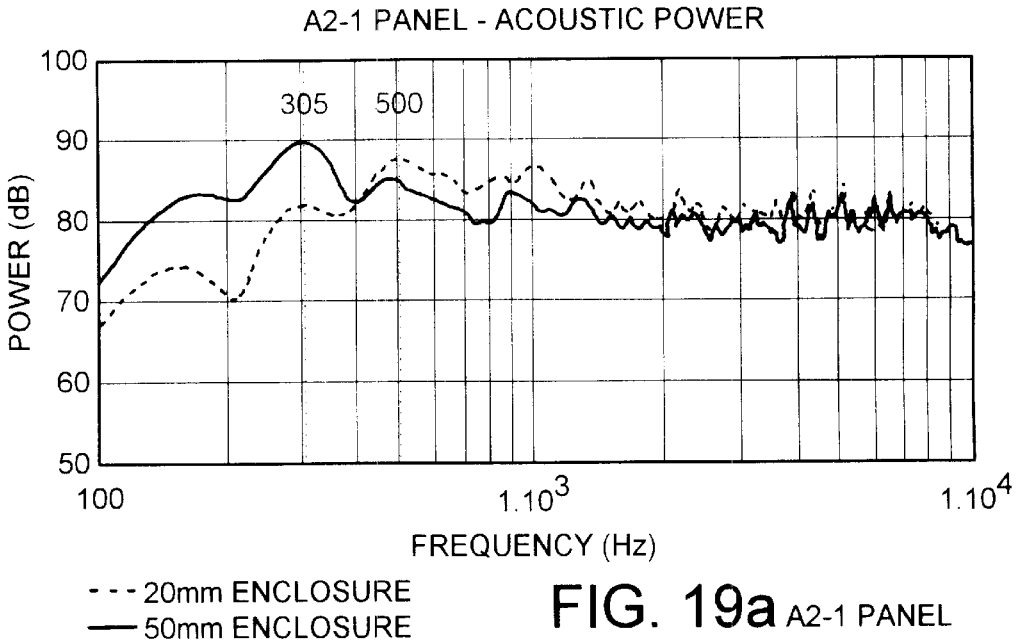
FIG. 19a A2-1 PANEL
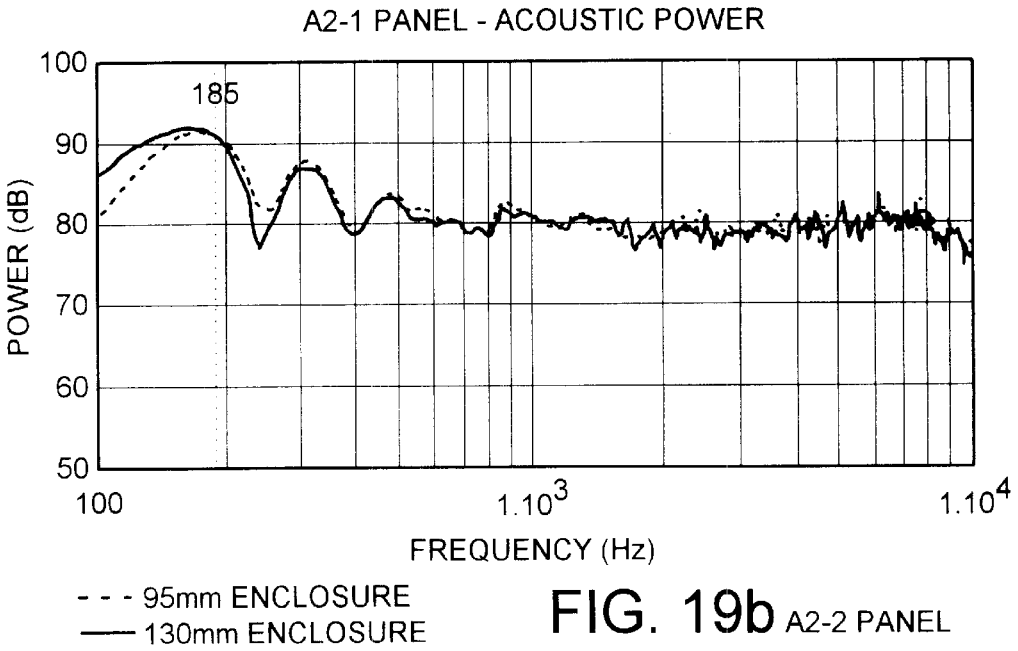
FIG. 19b A2-2 PANEL

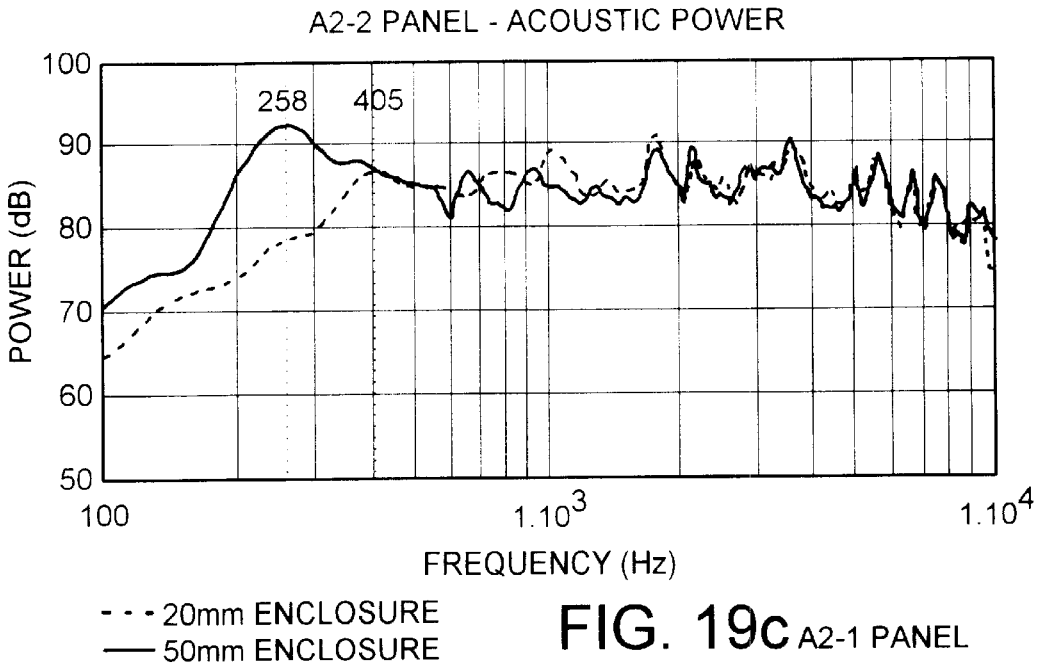
FIG. 19c A2-1 PANEL
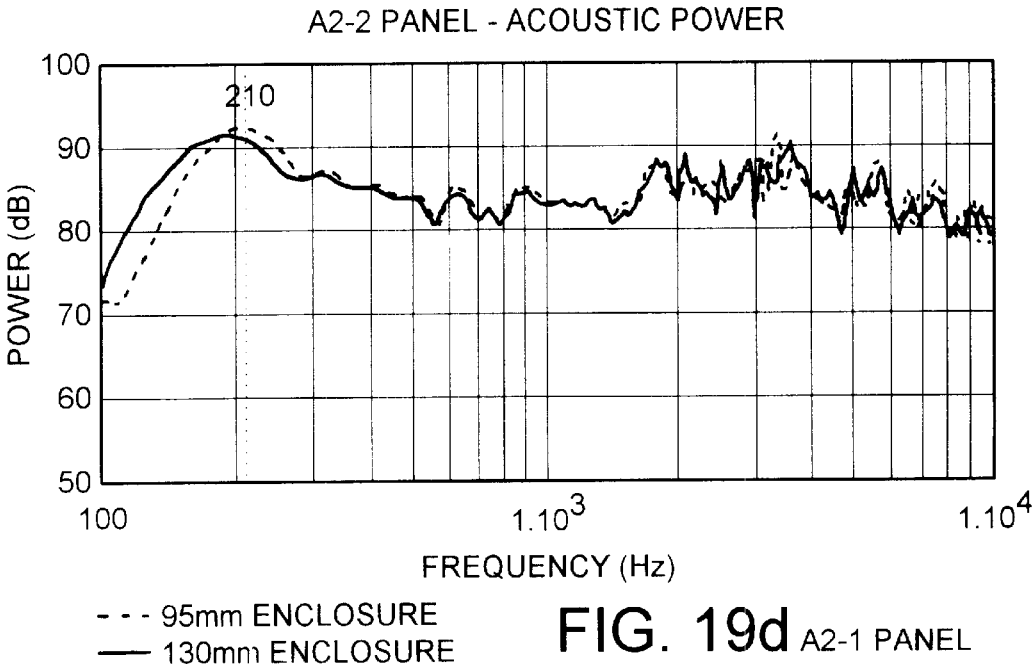
FIG. 19d A2-1 PANEL

A5-1 PANEL

A5-2 PANEL

A5-1 PANEL 483Hz

A5-1 PANEL 301Hz

A5-1 PANEL 817Hz

A5-1 PANEL

A2-1 Panel velocity at 153 Hz.
(95mm Enclosure)
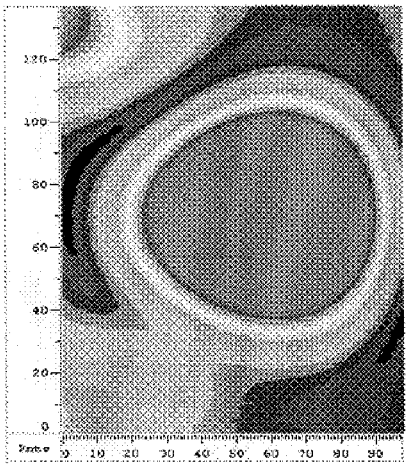
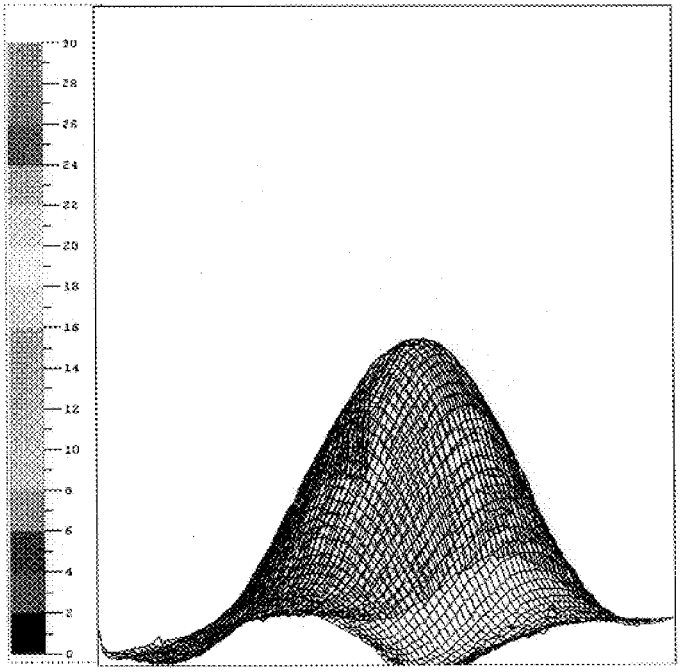
FIG. 24b

A2-2 Panel velocity at 194 Hz.
(95mm Enclosure)

A2-2 Panel velocity at 166 Hz.
(130mm Enclosure)

FREE SPACE

DOUBLE ENCLOSURE

A2-1 PANEL

A2-1 PANEL

ACOUSTIC DEVICE

This application is a continuation-in-part of application Ser. No. 08/707,012, filed Sep. 3, 1996 now U.S. Pat. No. 6,332,029.

TECHNICAL FIELD

The invention relates to acoustic devices and more particularly, but not exclusively, to loudspeakers incorporating resonant multi-mode panel acoustic radiators, e.g. of the kind described in parent application Ser. No. 08/707,012, and counterpart International application WO97/09842. Loudspeakers as described in WO97/09842 have become known as distributed mode (DM) loudspeakers.

BACKGROUND ART

Distributed mode loudspeakers (DML) are generally associated with thin, light and flat panels that radiate acoustic energy equally from both sides and in a complex diffuse fashion. While this is a useful attribute of a DML there are various real-world situations in which by virtue of the applications and their boundary requirements a monopolar form of a DML would be preferred.

In such applications the product may with advantage be light, thin and unobtrusive.

It is known from parent application Ser. No. 08/707,012 and International patent application WO97/09842 to mount a multi-mode resonant acoustic radiator in a relatively shallow sealed box whereby acoustic radiation from one face of the radiator is contained. In this connection it should be noted that the term 'shallow' in this context is relative to the typical proportions of a pistonic cone type loudspeaker drive unit in a volume efficient enclosure. A typical volume to pistonic diaphragm area ratio may be 80:1, expressed in ml to $cm^2$. A shallow enclosure for a resonant panel loudspeaker where pistonic drive of a pumped air volume is of little relevance, may have a ratio of 20:1.

SUMMARY OF THE INVENTION

According to the invention an acoustic device comprises a resonant multi-mode acoustic resonator or radiator panel having opposed faces, means defining a cavity enclosing at least a portion of one panel face and arranged to contain acoustic radiation from the said portion of the panel face, wherein the cavity is such as to modify the modal behaviour of the panel. The cavity may be sealed. A vibration exciter may be arranged to apply bending wave vibration to the resonant panel to produce an acoustic output, so that the device functions as a loudspeaker.

The cavity size may be such as to modify the modal behaviour of the panel.

The cavity may be shallow. The cavity may be sufficiently shallow that the distance between the internal cavity face adjacent to the said one panel face and the one panel face is sufficiently small as to cause fluid coupling the panel. The resonant modes in the cavity can comprise cross modes parallel to the panel, i.e. which modulate along the panel, and perpendicular modes at right angles to the panel. Preferably the cavity is sufficiently shallow that the cross modes (X,Y) are more significant in modifying the modal behaviour of the panel than the perpendicular modes (Z). In embodiments, the frequencies of the perpendicular modes can lie outside the frequency range of interest.

The ratio of the cavity volume to panel area (ml:$cm^2$) may be less than 10:1, say in the range about 10:1 to 0.2:1.

The panel may be terminated at its edges by a generally conventional resilient surround. The surround may resemble the roll surround of a conventional pistonic drive unit and may comprise one or more corrugations. The resilient surround may comprise foam rubber strips.

Alternatively the edges of the panel may be clamped in the enclosure, e.g. as described in our co-pending PCT patent application PCT/GB99/00848 dated Mar. 30, 1999.

Such an enclosure may be considered as a shallow tray containing a fluid whose surface may be considered to have wave-like behaviour and whose specific properties depend on both the fluid (air) and the dimensional or volume box geometry. The panel is placed in coupled contact with this active wave surface and the surface wave excitation of the panel excites the fluid. Conversely the natural wave properties of the fluid interact with the panel, so modifying its behaviour. This is a complex coupled system with new acoustic properties in the field.

From another aspect the invention is a method of modifying the modal behaviour of a resonant panel loudspeaker or resonator, comprising bringing the resonant panel into close proximity with a boundary surface to define a resonant cavity therebetween.

BRIEF DESCRIPTION OF DRAWINGS

FIG. 18 shows the mechanical impedance for various panels;

FIG. 19 shows the power response of various panels;

DETAILED DESCRIPTION

Figure 1:
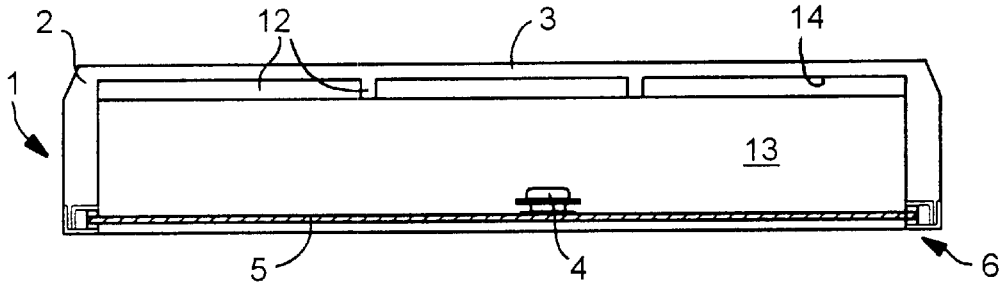
FIG. 1 is a cross section of a first embodiment of sealed box resonant panel loudspeaker.
Figure 2:
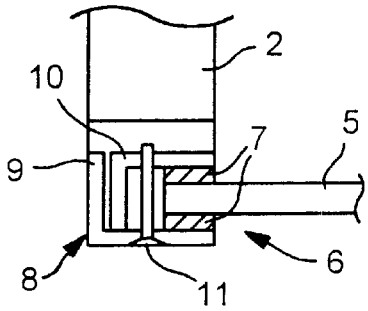
FIG. 2 is a cross-sectional detail, to an enlarged scale, of the embodiment of FIG. 1.

In the drawings and referring more particularly to FIGS. 1 and 2, a sealed box loudspeaker 1 comprises a box-like enclosure 2 closed at its front by a resonant panel-form acoustic radiator 5 of the kind described in U.S. Ser. No. 08/707,012 to define a cavity 13. The radiator 5 is energised by a vibration exciter 4 and is sealed to the enclosure round its periphery by a resilient suspension 6. The suspension 6 comprises opposed resilient strips 7, e.g. of foam rubber mounted in respective L-section frame members 9,10 which are held together by fasteners 11 to form a frame 8. The interior face 14 of the back wall 3 of the enclosure 2 is formed with stiffening ribs 12 to minimise vibration of the back wall. The enclosure may be a plastics moulding or a casting incorporating the stiffening ribs.

The panel in this embodiment may be of A2 size and the depth of the cavity 13 may be 90 mm.

Figure 3:
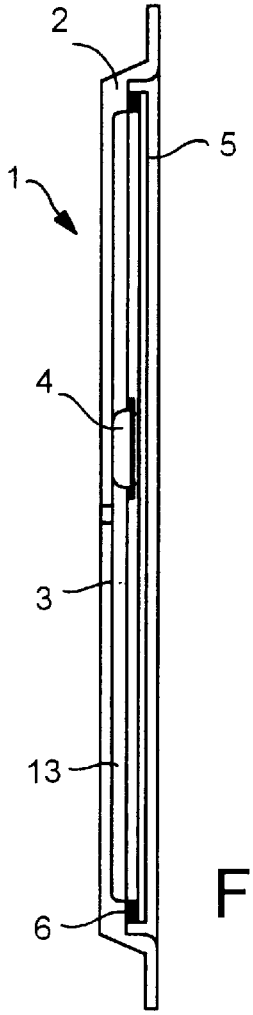
FIG. 3 is a cross section of a second embodiment of sealed box resonant panel loudspeaker.

The loudspeaker embodiment of FIG. 3 is generally similar to that of FIGS. 1 and 2, but here the radiator panel 5 is mounted on a single resilient strip suspension 6, e.g. of foam rubber, interposed between the edge of the radiator 5 and the enclosure to seal the cavity. The radiator panel size may be A5 and the cavity depth around 3 or 4 mm.

It will be appreciated that although the embodiments of FIGS. 1 to 3 relate to loudspeakers, it would equally be possible to produce an acoustic resonator for modifying the acoustic behaviour of a space, e.g. a meeting room or auditorium, using devices of the general kind of FIGS. 1 to 3, but which omit the vibration exciter 4.

It is shown that a panel in this form of deployment can provide a very useful bandwidth with quite a small enclosure volume with respect to the diaphragm size, as compared with piston speakers. The mechanisms responsible for the minimal interaction of this boundary with the distributed mode action are examined and it is further shown that in general a simple passive equalisation network may be all that is required to produce a flat power response. It is also demonstrated that in such a manifestation, a DML can produce a near-ideal hemispherical directivity pattern over its working frequency range into a 2 Pi space.

A closed form solution is presented which is the result of solving the bending wave equations for the coupled system of the panel and enclosure combination. The system acoustic impedance function is derived and is in turn used to calculate the effect of the coupled enclosure on the eigen-frequencies, and predicting the relevant shifts and additions to the plate modes.

Finally, experimental measurement data of a number samples of varying lump parameters and sizes are investigated and the measurements compared with the results from the analytical model.

Figure 4:
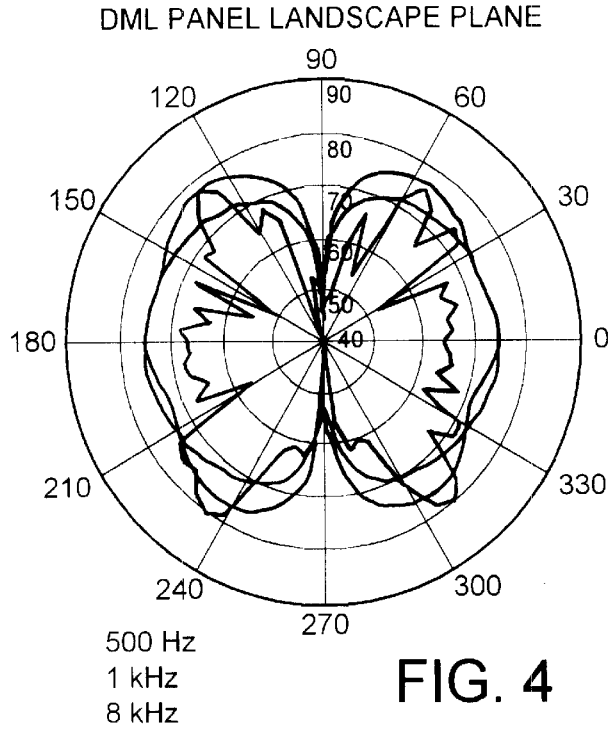
FIG. 4 shows the polar response of a DML free-radiating on both sides.
Figure 5:
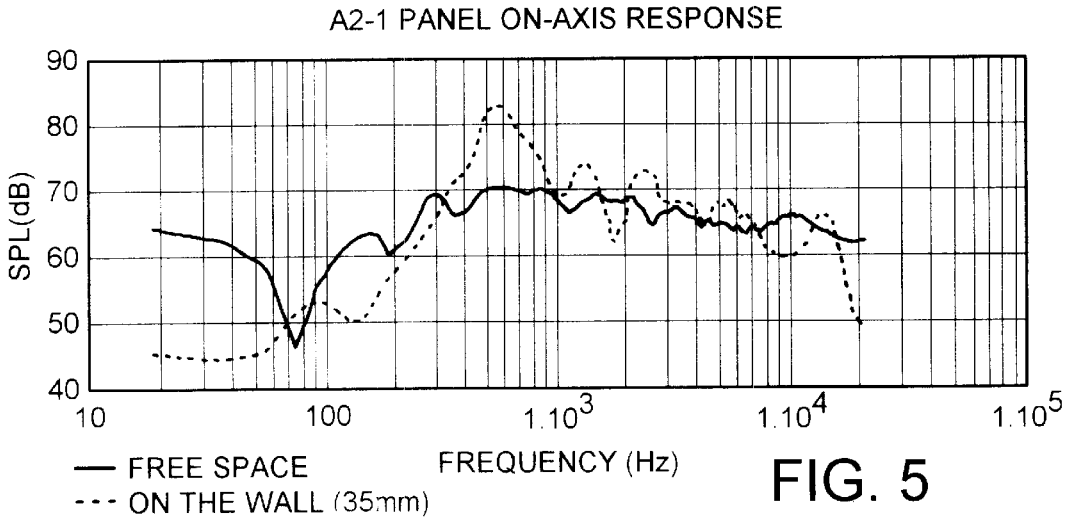
FIG. 5 shows a comparison between the sound pressure level in Free Space (solid line) and with the DML arranged 35mm from the wall (dotted line)

FIG. 4 illustrates a typical polar response of a free DML. Note that the reduction of pressure in the plane of the panel is due to the cancellation effect of acoustic radiation at or near the edges. When a free DML is brought near a boundary, in particular parallel with the boundary surface, acoustic interference starts to take place as the distance to the surface is reduced below about 15 cm, for a panel of approximately 500 $cm^2$ surface area. The effect varies in its severity and nature with the distance to the boundary as well as the panel size. The result, nonetheless is invariably a reduction of low frequency extension, peaking of response in the lower midrange region, and some aberration in the midrange and lower treble registers as shown in the example of FIG. 5. Because of this, and despite the fact that the peak can easily be compensated for, application of a 'free' DML near a boundary becomes rather restrictive.

Figure 6:
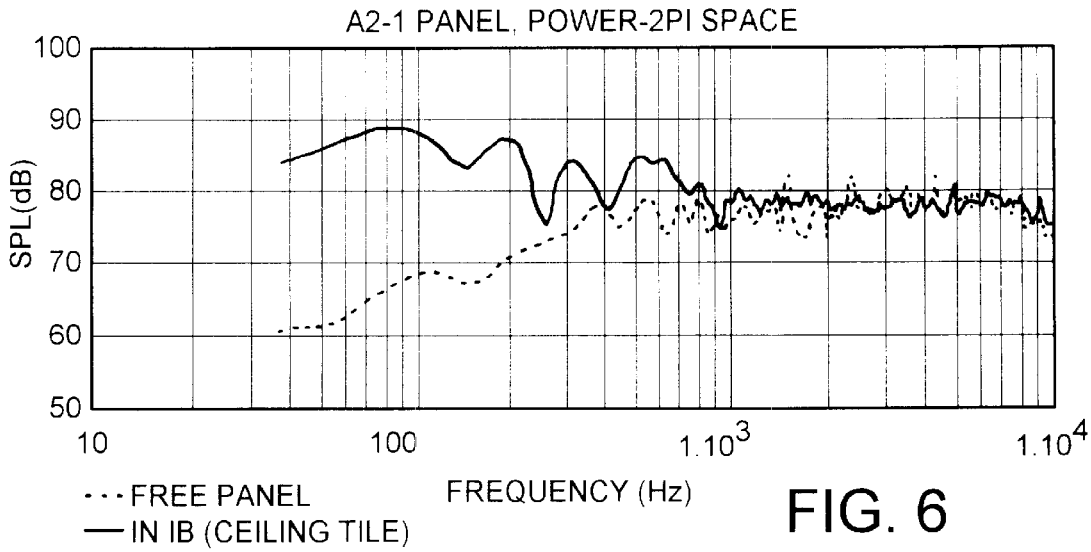
FIG. 6 shows a comparison between the acoustic power of a DML in free space (dotted line) and with a baffle around the panel between the front and rear.

When a DML is placed in a closed box or so-called "infinite baffle" of sufficiently large volume, radiation due to the rear of the panel is contained and that of the front is generally augmented in its mid and low frequency response, benefiting from two aspects. First is due to the absence of interference effect, caused by the front and rear radiation, at frequencies whose acoustic wavelengths in air are comparable to the free panel dimensions; and second, from the mid to low frequency boundary reinforcement due to baffling and radiation into 2 Pi space, see FIG. 6. Here we can see that almost 20 dB augmentation at 100 Hz is achieved from a panel of 0.25 $m^2$ surface area.

Whilst this is a definite advantage in maximising bandwidth, it may not be possible to incorporate in practice unless the application would lend itself to such a solution. Suitable applications include ceiling tile loudspeakers and custom in-wall installation.

In various other applications there may be a definite advantage to utilise the benefits of the "infinite baffle" configuration, without having the luxury of a large closed volume of air behind the panel. Such applications may also benefit from an overall thinness and lightness of the loudspeaker. It is an object of the present invention to bring understanding to this form of deployment and offer analytical solutions.

A substantial volume of work supports conventional piston loudspeakers in various modes of operation, especially in predicting their low frequency behaviour when used in an enclosure. It is noteworthy that distributed mode loudspeakers are of very recent development and as such there is virtually no prior knowledge of the issues involved to assist with the derivation of solutions for similar analysis. In what follows, an approach is adopted which provides a useful set of solutions for a DML deployed in various mechanoacoustic interface conditions including loading with a small enclosure.

Figure 7:
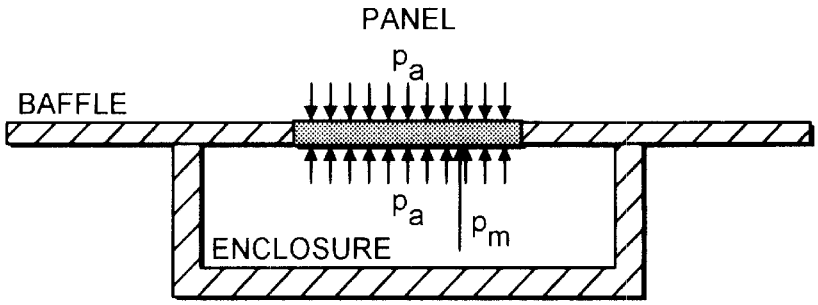
FIG. 7 shows a loudspeaker according to the invention.
Figure 8:
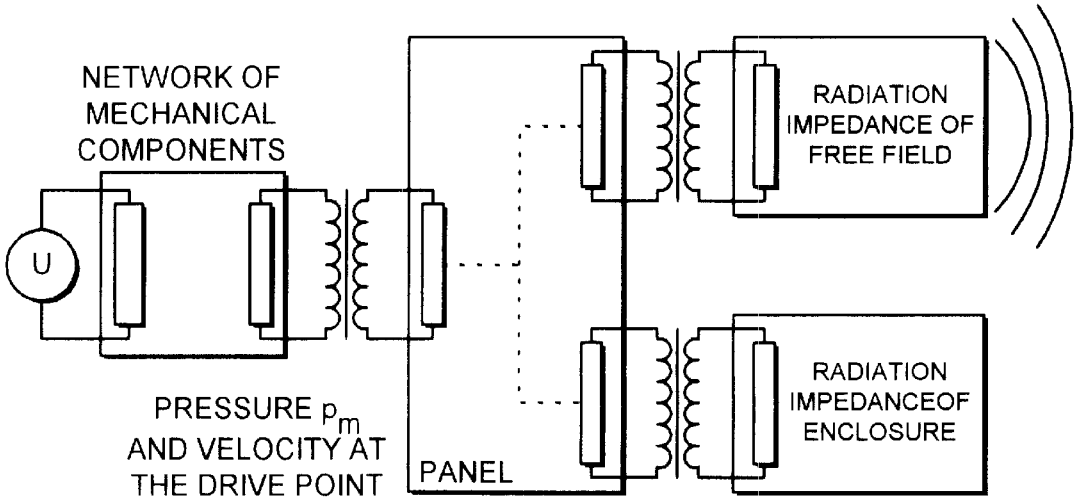
FIG. 8 shows a DML panel system.

The system under analysis is shown schematically in FIG. 7. In this example the front side of the panel radiates into free space, whilst the other side is loaded with an enclosure. This coupled system may be treated as a network of velocities and pressures are shown in the block diagram of FIG. 8. The components are, from left to right; the electromechanical driving section, the modal system of the panel, and the acoustical systems.

The normal velocity of the bending-wave field across a vibrating panel is responsible for its acoustic radiation. This radiation in turn leads to a reacting force which modifies the panel vibration. In the case of a DML radiating equally from both sides, the radiation impedance, which is the reacting element, is normally insignificant as compared with the mechanical impedance of the panel. However, when the panel radiates into a small enclosure, the effect of acoustic impedance due to its rear radiation is no longer small, and in fact it will modify and add to the scale of the modality of the panel.

Figure 9:
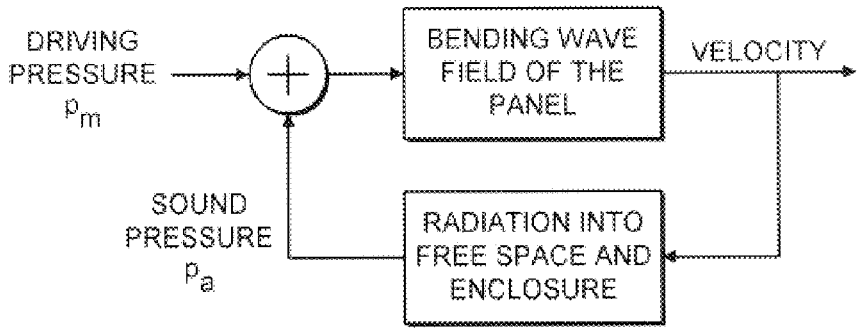
FIG. 9 illustrates the coupling of components.

This coupling, as shown in FIG. 9, is equivalent to a mechanoacoustical closed loop system in which the reacting sound pressure is due to the velocity of the panel itself. This pressure modifies the modal distribution of the bending wave field which in turn has an effect on the sound pressure response and directivity of the panel.

In order to calculate directivity and to inspect forces and flows within the system, it is necessary to solve for the plate velocity. This far-field sound pressure response can then be obtained with the help of Fourier transformation of this velocity as described in an article by PANZER, J; HARRIS, N; entitled "Distributed Mode Loudspeaker Radiation Simulation" presented at the $105^{th}$ AES Convention, San Francisco 1998 #4783. The forces and flows can then be found with the help of network analysis.

This problem can be approached by developing the velocities and pressures of the total system in terms of the in-vacuum panel eigen-functions (3,4) as explained in CREMER, L; HECKL, M; UNGAR, E; "Structure-Borne Sound" SPRINGER 1973 and BLEVINS, R. D. "Formulas for Natural frequency and Mode Shape", KRIEGER Publ., Malabar 1984. For example, the velocity at any point on the panel can be calculated from equation (1).

$$v_{(x,y)} = \sum_{i=0}^{\infty} Y_{pi(j\omega)} \cdot F_{oi(j\omega)} \cdot \phi_{pi(x_o,y_o)} \cdot \phi_{pi(x,y)} \tag{1}$$

This series represents a solution to the differential equation describing the plate bending waves, equation (2), when coupled to the electromechanical lumped element network as well as its immediate acoustic boundaries.

$$L_B\{v_{(x,y)}\} - \mu \cdot \omega^2 \cdot v_{(x,y)} = j\omega \cdot p_{m(x,y)} - j\omega \cdot p_{a(x,y)} \tag{2}$$

$L_B$ is the bending rigidity differential operator of fourth order in x and y, v is the normal component of the bending wave velocity. $\mu$ is the mass per unit area and $\omega$ is the driving frequency. The panel is disturbed by the mechanical driving pressure, $p_m$, and the acoustic reacting sound pressure field, $p_a$, FIG. 7.

Each term of the series in equation (1) is called a modal velocity, or, a "mode" in short. The model decomposition is a generalised Fourier transform whose eigen-functions $\Phi_{pi}$ share the orthogonality property with the sine and cosine functions associated with Fourier transformation. The orthogonality property of $\phi_{pi}$ is a necessary condition to allow appropriate solutions to the differential equation (2). The set of eigen-functions and their parameters are found from the homogenous version of equation (2) i.e. after switching off the driving forces. In this case the panel can only vibrate at its natural frequencies or the so-called eigen-frequencies, $\omega_1$, in order to satisfy the boundary conditions.

In equation (2), $\phi_{pi(x,y)}$ is the value of the $i^{th}$ plate eigen-function at the position where the velocity is observed. $\phi_{pi\ (xo,yo)}$ is the eigen-function at the position where the driving force $F_{pi\ (j\omega)}$ is applied to the panel. The driving force includes the transfer functions of the electromechanical components associated with the driving actuator at $(x_o,y_o)$, as for example exciters, suspensions, etc. Since the driving force depends on the panel velocity at the driving point, a similar feedback situation as with the mechanoacoustical coupling exists at the drive point(s), albeit the effect is quite small in practice.

Figure 10:
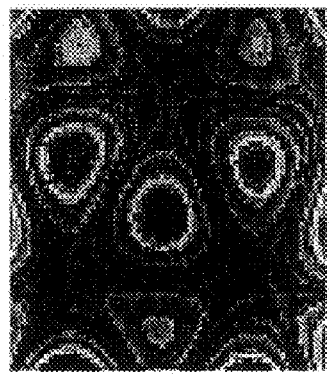
FIG. 10 illustrates a single plate eigen-function.

FIG. 10 gives an example of the velocity magnitude distribution of a single eigen-function across a DML panel. The black lines are the nodal lines where the velocity is zero. With increasing mode index the velocity pattern becomes increasingly more complex. For a medium sized panel approximately 200 modes must be summed in order to cover the audio range.

The modal admittance, $Y_{pi(j\omega)}$, is the weighting function of the modes and determines with which amplitude and in which phase the $i^{th}$ mode takes part in the sum of equation (1). $Y_{pi}$, as described in equation (3), depends on the driving frequency, the plate eigen-value and, most important in the context of this paper, on the acoustic impedance of the enclosure together with the impedance due to the free field radiation.

$$Y_{pi(s)} = \frac{1}{R_{pi}} \cdot \frac{s_p \cdot d_{pi}}{s_p^2 + s_p \cdot d_{pi} + \gamma_{pi\ v}^2} \tag{3}$$

$s_p = s/_{\omega p}$ is the Laplace frequency variable normalised to the fundamental panel frequency, $_{\omega p}$, which in turn depends on the bending stiffness $K_p$ and mass $M_p$ of the panel, namely $_{\omega p}{}^2 = K_p/M_p$. $R_{pi}$ is the modal resistance due to material losses and describes the value of $Y_{pi(j\omega)}$ at resonance when $s_p = \lambda_{pi}$. $\lambda_{pi}$ is a scaling factor and is a function of the $i^{th}$ plate eigen-value $\lambda_{pi}$ and the total radiation impedance $Z_{mai}$ as described in equation (4).

$$\gamma_{pi(s)} = \sqrt{\lambda_{pi}^4 + s_p \cdot Z_{ma\ i(j\omega)} \sqrt{\frac{1}{K_p \cdot M_p}}} \tag{4}$$

Figure 11:
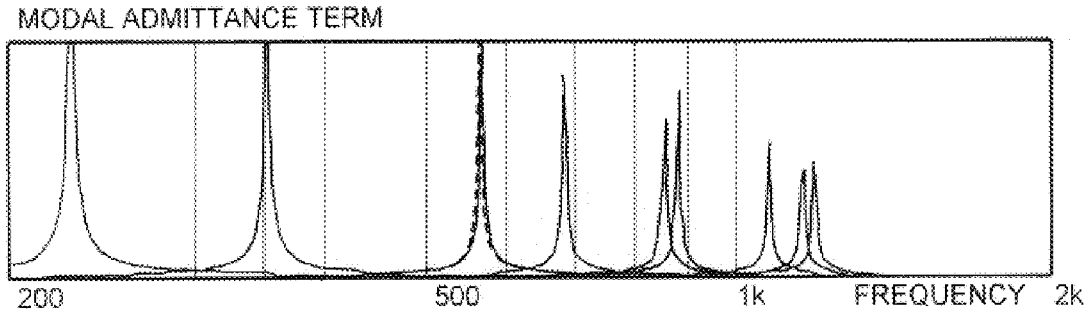
FIG. 11 shows the magnitudes of the frequency response of the first ten in-vacuum panel modes.

In the vacuum case ($Z_{mai}$=0) the second term in equation (3) becomes a band-pass transfer function of second order with damping factor $d_{pi}$. FIG. 11 shows the magnitudes of the frequency response of the in-vacuum $Y_{pi(j\omega)}$ for the first ten modes of a panel, when clamped at the edges. The panel eigen-frequencies coincide with the peaks of these curves.

Figure 12:
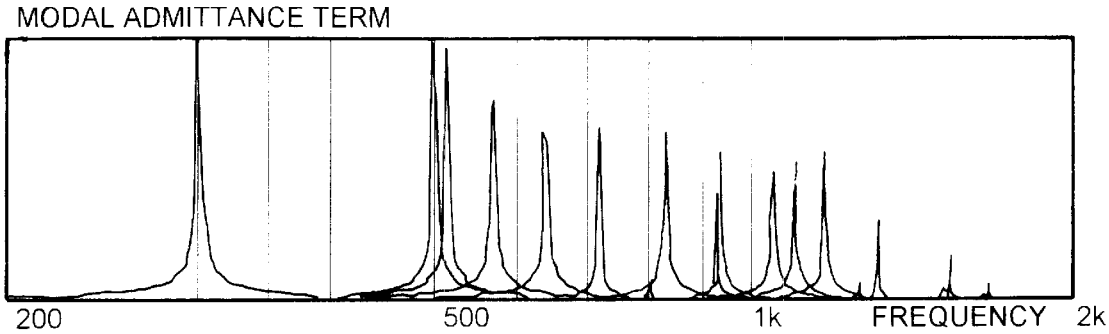
FIG. 12 shows the magnitudes of the frequency response of the same modes in a loudspeaker according to the embodiment of the invention.

If the same panel is now mounted onto an enclosure, the modes will not only be shifted in frequency but also modified, as seen in FIG. 12. This happens as a result of the interaction between the two modal systems of the panel and the enclosure, where the modal admittance of the total system is no longer a second order function as in the in-vacuum case. In fact, the denominator of equation (3) could be expanded in a polynomial of high order, which will reflect the resulting extended characteristic function.

Figure 13:
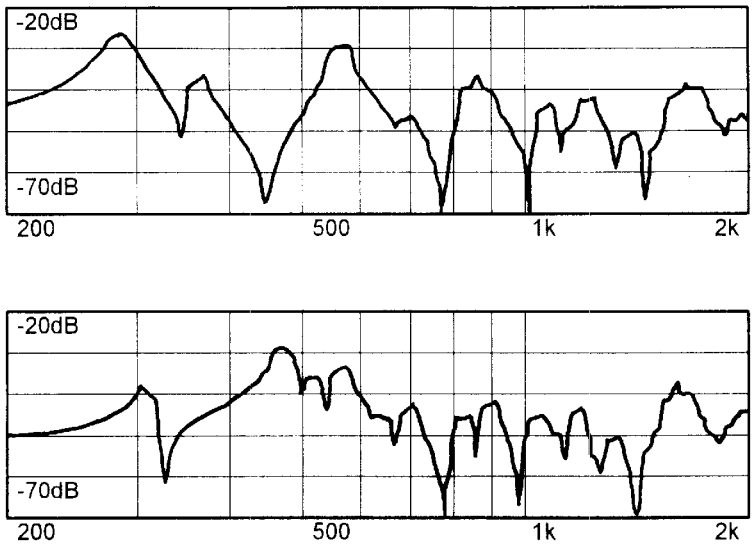
FIG. 13 shows the effect of the enclosure on the panel velocity spectrum.

The frequency response graphs of FIG. 13 shows the effect of the enclosure on the panel velocity spectrum. The two frequency response curves are calculated under identical drive condition, however, the left-hand graph displays the in-vacuum case, whilst the right hand graph shows the velocity when both sides of the panel are loaded with an enclosure. A double enclosure was used in this example in order to exclude the radiation impedance of air. The observation point is at the drive point of the exciter.

Clearly visible is the effect of the panel eigen-frequency shift to higher frequencies in the right diagram, which was also seen in FIG. 12. It is noteworthy that as a result of the enclosure influence, and the subsequent increase in the number and density of modes, a more evenly distributed curve describing the velocity spectrum is obtained.

The mechanical radiation impedance is the ratio of the reacting force, due to radiation, and the panel velocity. For a single mode, the radiation impedance can be regarded as constant across the panel area and may be expressed in terms of the acoustical radiated power $P_{ai}$ of a single mode.

Thus the modal radiation impedance of the $i^{th}$ mode may be described by equation (5).

$$Z_{mai} = 2 \cdot \frac{P_{ai}}{< v_i >^2} \tag{5}$$

$<v_i>$ is the mean velocity across the panel associated with the $i^{th}$ mode. Since this value is squared and therefore always positive and real, the properties of the radiation impedance $Z_{mai}$ are directly related to the properties of the acoustical power, which is in general a complex value. The real part of $P_{ai}$ is equal to the radiated far-field power, which contributes to the resistive part of $Z_{mai}$, causing damping of the velocity field of the panel. The imaginary part of $P_{ai}$ is caused by energy storing mechanisms of the coupled system, yielding to a positive or negative value for the reactance of $Z_{mai}$.

A positive reactance is caused by the presence of an acoustical mass. This is typical, for example, of radiation into free space. A negative reactance of $Z_{mai}$, on the other hand, is indicative of the presence of a sealed enclosure with its equivalent stiffness. In physical terms, a 'mass' type radiation impedance is caused by a movement of air without compression, whereas a 'spring' type impedance exists when air is compressed without shifting it.

Figure 14:
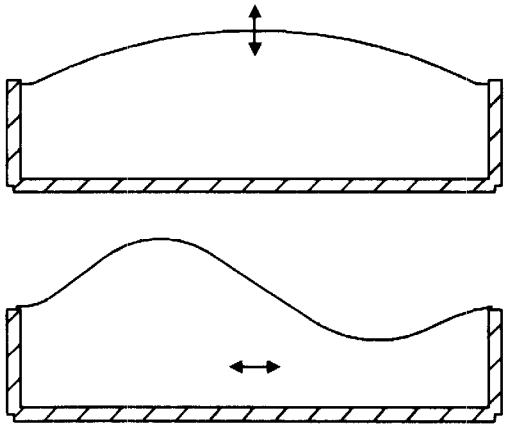
FIG. 14 illustrates two mode shapes.

The principal effect of the imaginary part of the radiation impedance is a shift of the in-vacuum eigen-frequencies of the panel. A positive reactance of $Z_{mai}$ (mass) causes a down-shift of the plate eigen-frequencies, whereas a negative reactance (stiffness) shifts the eigen-frequencies up. At a given frequency, the pane-mode itself dictates which effect will be dominating. This phenomenon is clarified by the diagram of FIG. 14, which shows that symmetrical mode shapes cause compression of air, 'spring' behaviour, whereas asymmetrical mode shapes shift the air side to side, yielding an acoustical 'mass' behaviour. New modes, which are not present in either system when they are apart, are created by the interaction of the panel and enclosure reactances.

Figure 15:
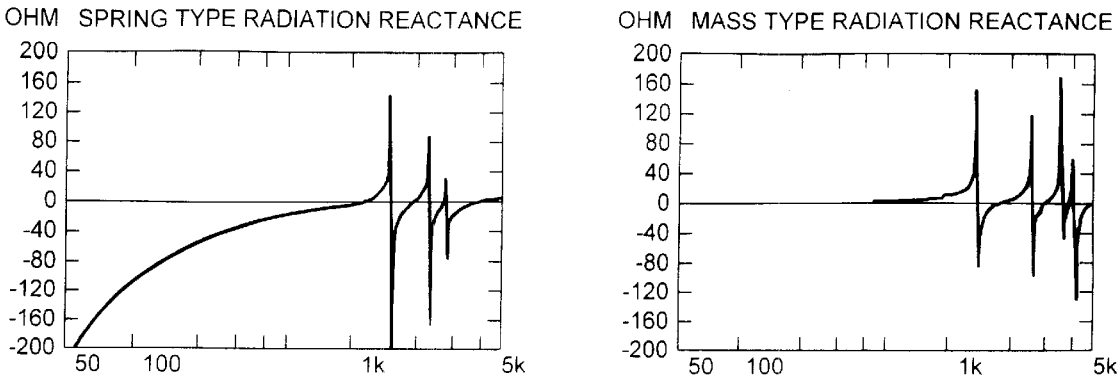
FIG. 15 shows the frequency response of the reactance.

FIG. 15 shows the frequency response of the imaginary part of the enclosure radiation impedance. The left-hand graph displays a 'spring-type' reactance, typically produced by a symmetrical panel-mode. Up to the first enclosure eigen-frequency the reactance is mostly negative. In-vacuum eigen-frequencies of the panel, which are within this frequency region, are shifted up. In contrast the right diagram displays a 'mass-type' reactance behaviour, typically produced by an asymmetrical panel mode.

If the enclosure is sealed and has a rigid wall parallel to the panel surface, as in our case here, then the mechanical radiation impedance for the $i^{th}$-plate mode is (5):

$$Z_{mai} = -j \cdot \omega \cdot \rho_a \cdot \frac{A_0^2}{A_d} \cdot \sum_{k,l} \frac{\Psi_{(i,k,l)}^2}{k_{z(k,l)} \cdot \tan(k_{z(k,l)} \cdot L_{dz})} \tag{6}$$

$\psi_{(i,k,l)}$ is the coupling integral which takes into account the cross-sectional boundary conditions and involves the plate and enclosure eigen-functions. The index, i, in equation (6) is the plate mode-number; $L_{dz}$ is the depth of the enclosure; and $k_z$ is the modal wave-number component in the z-direction (normal to the panel). For a rigid rectangular enclosure $k_z$ is described by equation (7):

$$k_{z(k,l)} = \sqrt{k_a^2 - \left[\left(\frac{k \cdot \pi}{L_{dx}}\right)^2 + \left(\frac{l \cdot \pi}{L_{dy}}\right)^2\right]} \tag{7}$$

The indices, k and l, are the enclosure cross-mode numbers in x and y direction, where $L_{dx}$ and $L_{dy}$ are enclosure dimensions in this plane. $A_0$ is the area of the panel and $A_d$ is cross-sectional area of the enclosure in the x and y plane.

Equation (6) is a complicated function, which describes the interaction of the panel modes and the enclosure modes in detail. In order to understand the nature of this formula, let us simplify it by constraining the system to the first mode of the panel and to the z-modes of the enclosure only (k=l=0). This will result in the following simplified relationship.

$$Z_{ma0} = -j \cdot Z_a \cdot \frac{A_0^2}{A_d} \cdot \cot(k_Z \cdot L_{dz}) \tag{8}$$

Equation (8) is the well known driving point impedance of a closed duct (6). If the product $k_z.L_{dz}<<1$ then a further simplification can be made as follows.

$$Z_{ma0} = A_0^2 \cdot \frac{1}{j \cdot \omega \cdot C_{ab}} \tag{9}$$

where $C_{ab}=V_b/(\rho_a.c_a^2)$ is the acoustical compliance of the enclosure of volume $V_b$. Equation (9) is the low frequency lumped element model of the enclosure. If the source is a rigid piston of mass $M_{ms}$ with a suspension having a compliance $C_{ms}$ then the fundamental 'mode' has the eigenvalue $\lambda_{po}=1$ and the scaling factor of the coupled system of equation (4) becomes the well known relationship as shown in equation (10),[1].

$$\gamma_{po} = \sqrt{1 + \frac{C_{ms}}{C_{mb}}} \tag{10}$$

with the equivalent mechanical compliance of the enclosure air volume $C_{mb}=C_{ab}/A_0^2$.

Various tests were carried out to investigate the effect of a shallow back enclosure on DM loudspeakers. In addition to bringing general insight into the behaviour of DNM panels in an enclosure, the experiments were designed to help verify the theoretical model and establish the extent to which such models are accurate in predicting the behaviour of the coupled modal system of a DML panel and its enclosure.

Two DML panels of different size and bulk properties were selected as our test objects. It was decided that these would be of sufficiently different size on the one hand, and of a useful difference in their bulk properties on the other, to cover a good range in scale. The first set 'A' was selected as a small A5 size panel of 149 mm×210 mm with three different bulk mechanical properties. These were A5-1, polycarbonate skin on polycarbonate honeycomb; A5-2 carbon fibre on Rohacell; and A5-3, Rohacell without skin. Set 'B' was chosen to be eight times larger, approximately to A2 size of 420 mm×592 mm. A2-1 was constructed with glass fibre skin on polycarbonate honeycomb core, whilst A2-2 was carbon fibre skin on aluminium honeycomb. Table 1 lists the bulk properties of these objects. Actuation was achieved by a single electrodynamic moving coil exciter at the optimum point. Two exciter types were used, where they suited most the size of the panels under test. In the case of A2 panels a 25mm exciter was employed with B1=2.3 Tm, Re=3.7 Ω and Le−60 μH, whilst a 13 mm model was used in the case of the smaller A5 panels with B1−1.0 Tm, Re=7.3 Ω and Le=36 μH.

| Panel | Type | B (Nm) | μ (Kg/m²) | Zm (Ns/m) | Size (mm) |
|---|---|---|---|---|---|
| A2-1 | Glass on PC Core | 10.4 | 0.89 | 24.3 | 5 × 592 × 420 |
| A2-2 | Carbon on AI Core | 57.6 | 1.00 | 60.0 | 7.2 × 592 × 420 |
| A5-1 | PC on PC core | 1.39 | 0.64 | 7.5 | 2 × 210 × 149 |
| A5-2 | Carbon on Rohacell | 3.33 | 0.65 | 11.8 | 2 × 210 × 149 |
| A5-3 | Rohacell core | 0.33 | 0.32 | 2.7 | 3 × 210 × 149 |

Panels were mounted onto a back enclosure with adjustable depth using a soft polyurethane foam for suspension and acoustic seal. The enclosure depth was made adjustable on 16,28,40 and 53 mm for set 'A' and on 20,50,95 and 130 mm for set 'B' panels. Various measurements were carried out at different enclosure depths for every test case and result documented.

Figure 16:
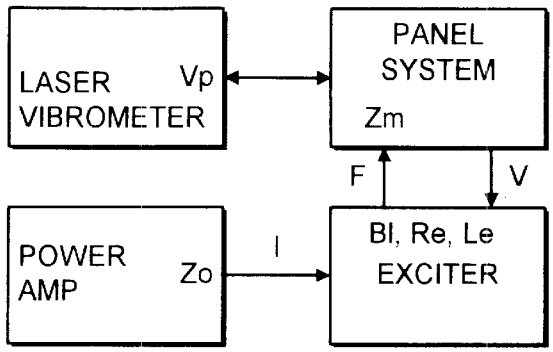
FIG. 16 illustrates panel velocity measurement.

Panel velocity and displacement were measured using a Laser Vibrometer. The frequency range of interest was covered with a linear frequency scale of 1600 points. The set-up shown in FIG. 16 was used to measure the panel mechanical impedance by calculating the ratio of the applied force to the panel velocity at the drive point.

$$Z_m = \frac{F}{V}$$

In this procedure, the applied force was calculated from the lump parameter information of the exciter.

Although panel velocity in itself feeds back into the electromechanical circuit, its coupling is quite weak. It can be shown that for small values of exciter B1, (1–3 Tm), providing that the driving amplifier output impedance is low (constant voltage), the modal coupling back to the electromechanical system is sufficiently weak to make this assumption plausible. Small error arising from this approximation was therefore ignored. FIGS. 18*a* to *f* show the mechanical impedance of the A5-1 and A5-2 panels, derived from the measurement of panel velocity and the applied force measured by the Laser Vibrometer. Note that the impedance minima for each enclosure depth occur at the system resonance mode.

Figure 17A:
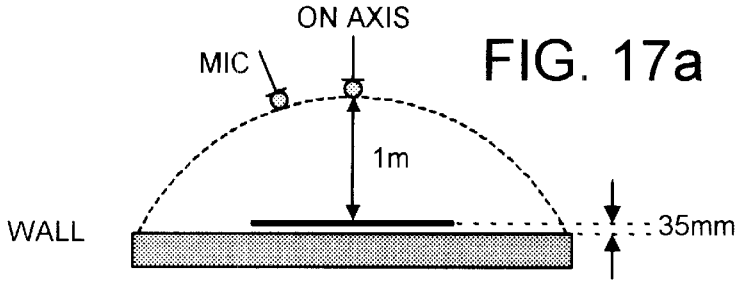
FIG. 17 illustrates the microphone set up for the measurements.

Sound pressure level and polar response of the various panels were measured in a large space of 350 cubic meters and gated at 12 to 14 ms for anechoic response using MLSSA, depending on the measurement. Power measurements were carried out employing a 9-microphone array system, as shown in FIG. 17*d* and in a set-up shown in FIG. 17*a*. These are plotted in FIGS. 19*a* to *f* for various enclosure depths. System resonance is highlighted by markers on the graphs.

Figure 20A:
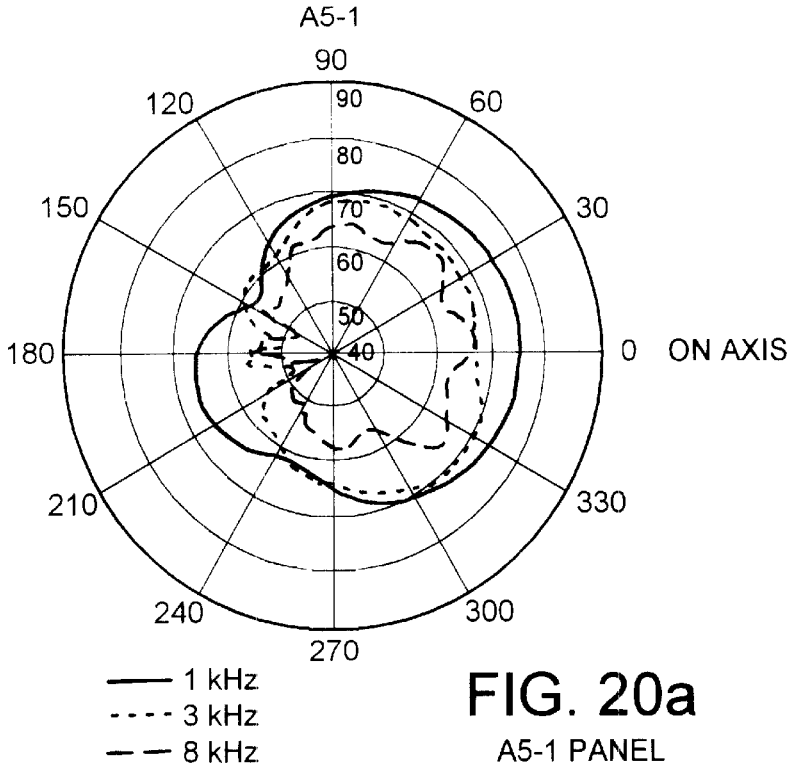
FIG. 20 shows the polar response of various panels.
Figure 20B:
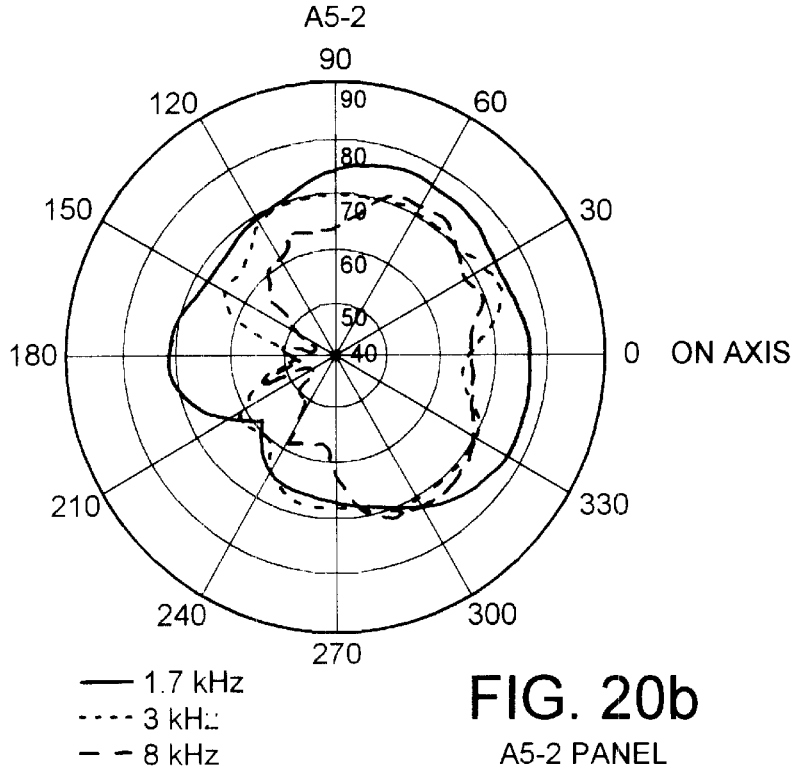

Polar response of the A5-1 and A5-2 panels were measured for a 28 mm deep enclosure and the result is shown in FIGS. 20*a* and *b*. When compared with the polar plot of the free DML in FIG. 1, they demonstrate the significance of the closed-back DML in its improved directivity.

Figure 21:
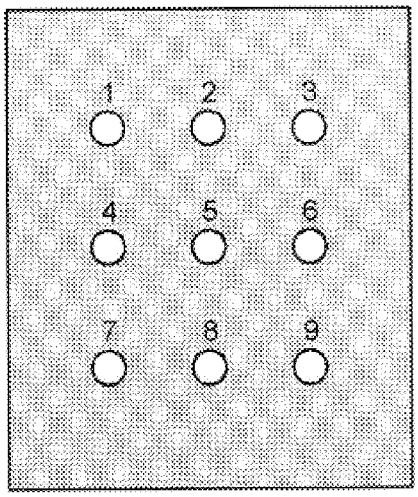
FIG. 21 shows a microphone set up for measuring the internal pressure in the enclosure.

To investigate further the nature and the effect of enclosure on the panel behaviour, especially at the combined system resonance, a special jig was made to allow the measurement of the internal pressure of the enclosure at nine predetermined points as shown in FIG. 21. The microphone was inserted in the holes provided within the back-plate of an A5 enclosure jig at a predetermined depth, while the other eight position holes were tightly blocked with hard rubber grommets. The microphone was mechanically isolated from the enclosure by an appropriate rubber grommet during the measurement.

Figure 22A:
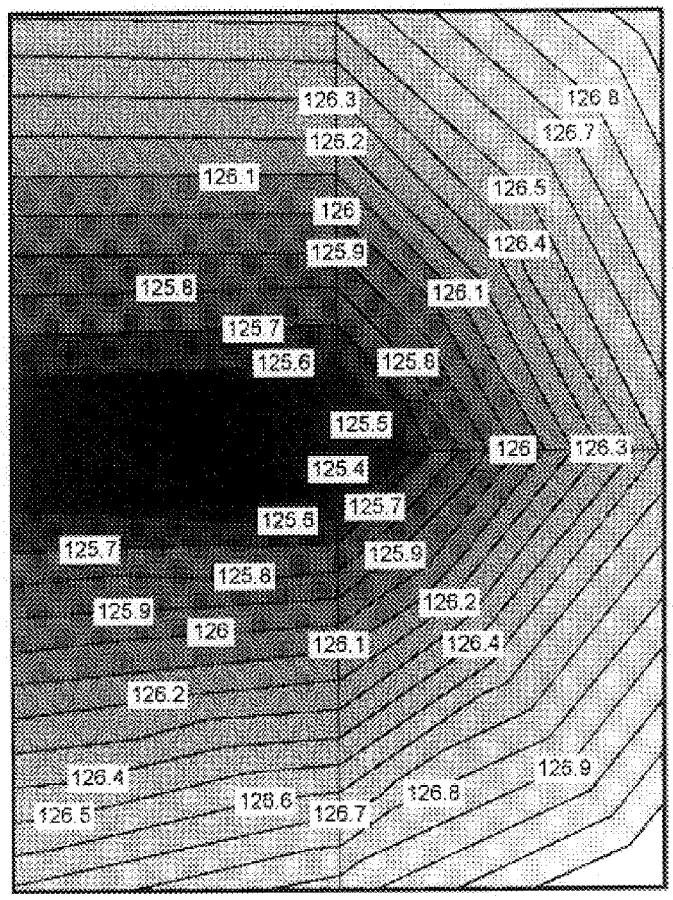
FIG. 22 shows the internal pressure contour.
Figure 22B:
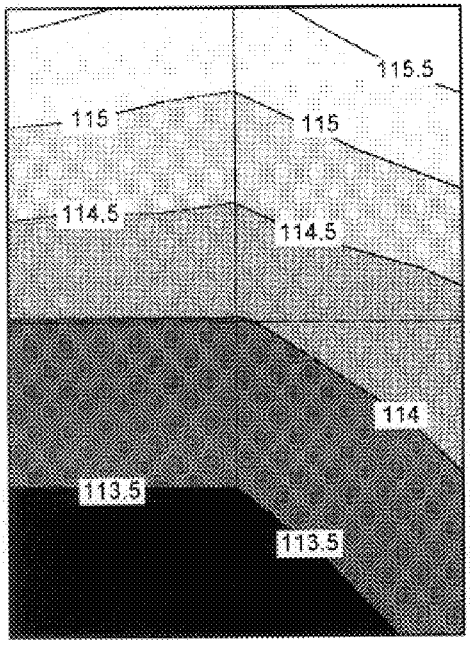
Figure 22C:
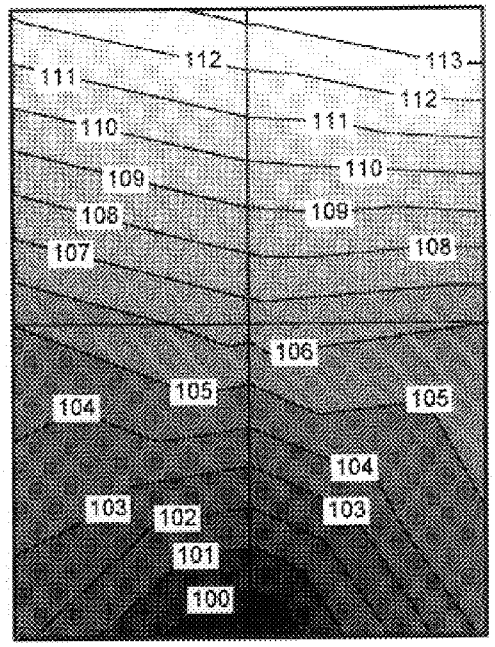
Figure 23:
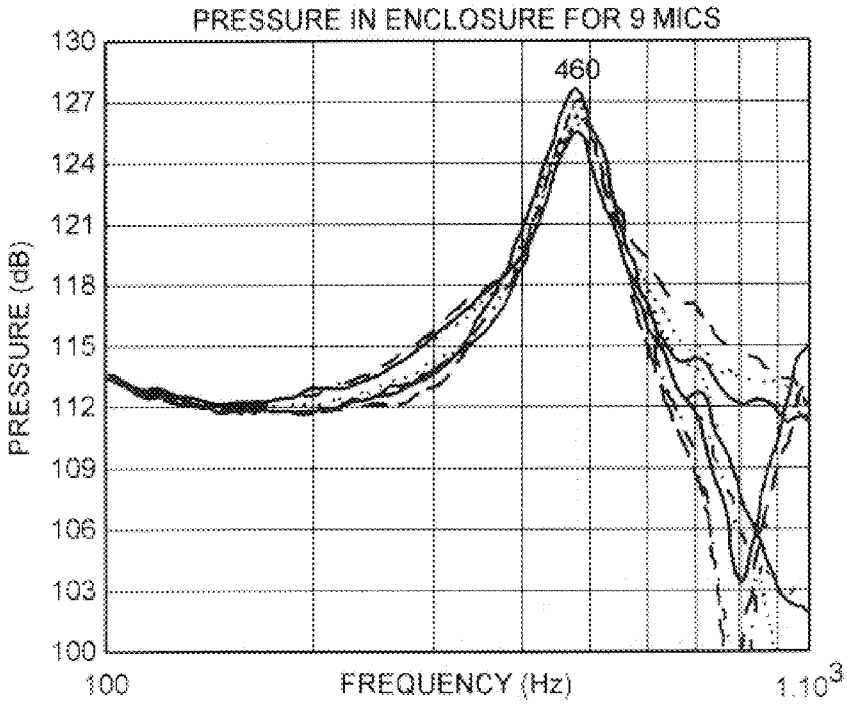
FIG. 23 shows the internal pressure measured using the array of FIG. 21.
Figure 24A:
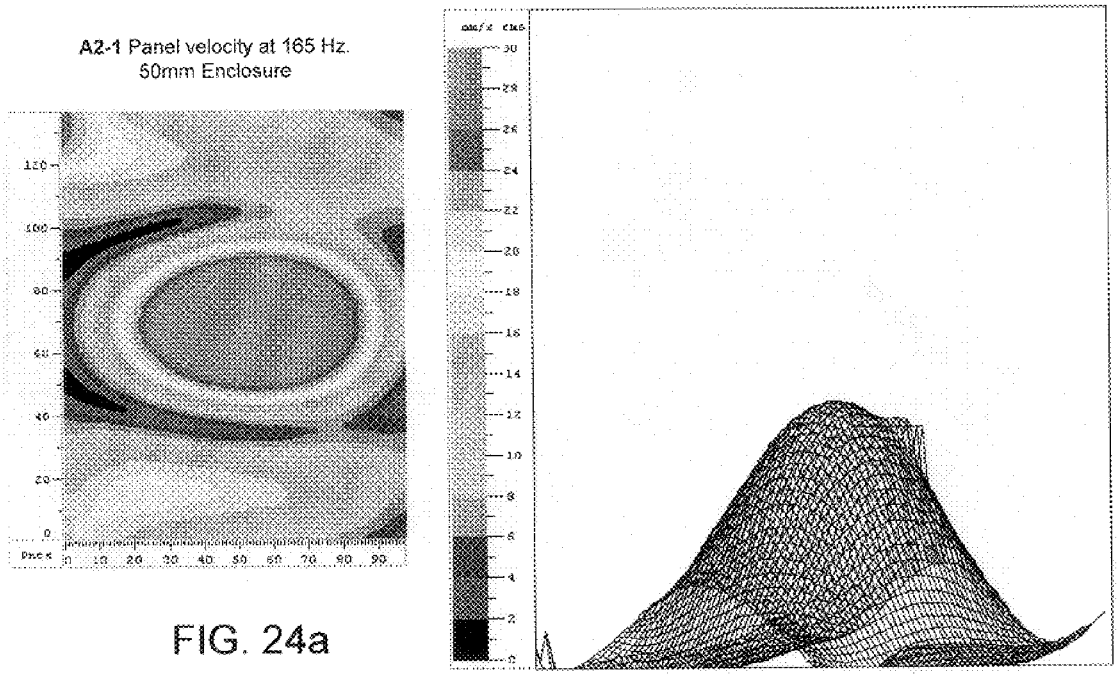
FIG. 24 shows the velocity and displacement of various panels.
Figure 24C:
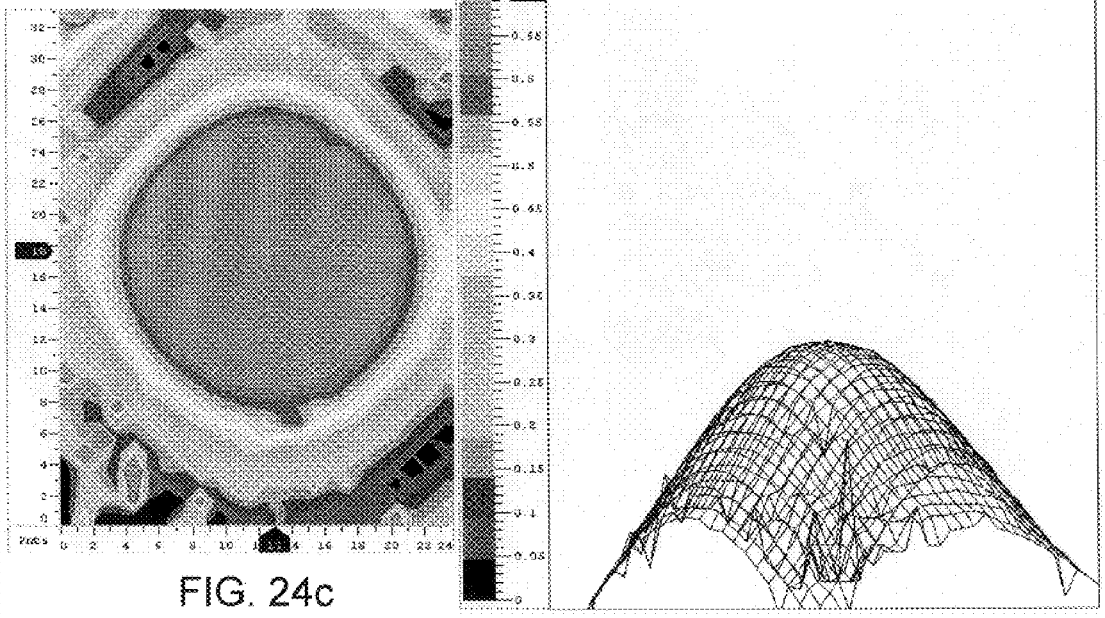
Figure 24D:
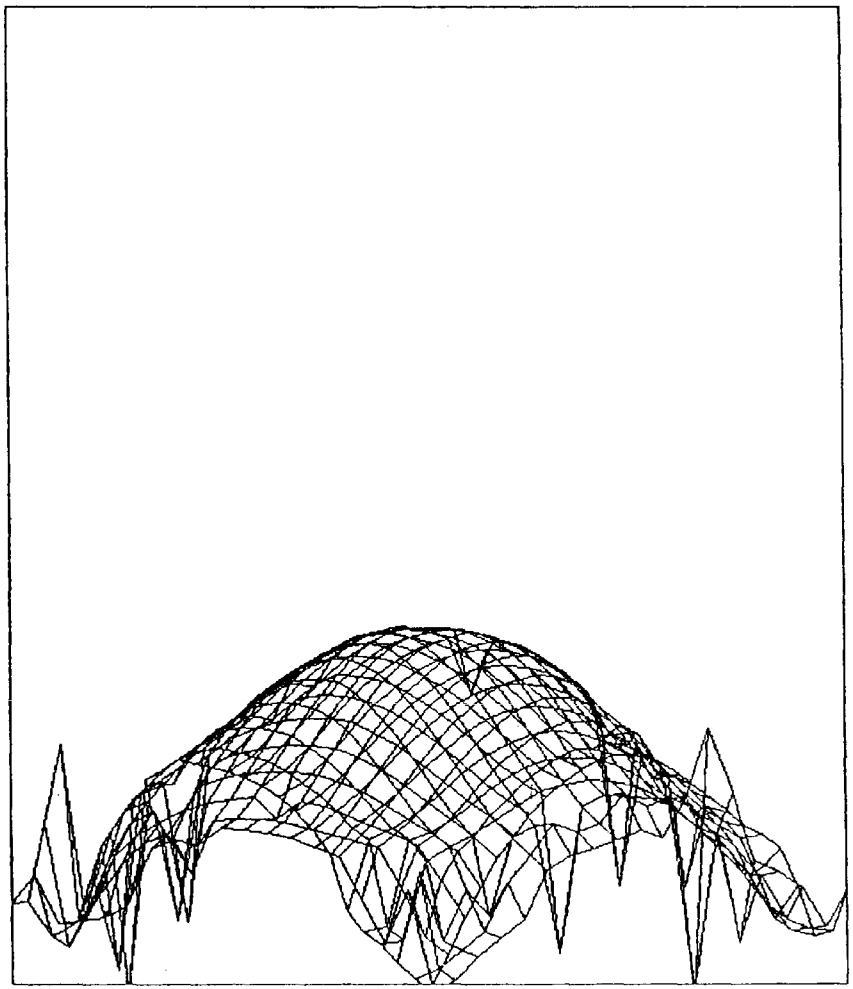
Figure 27A:
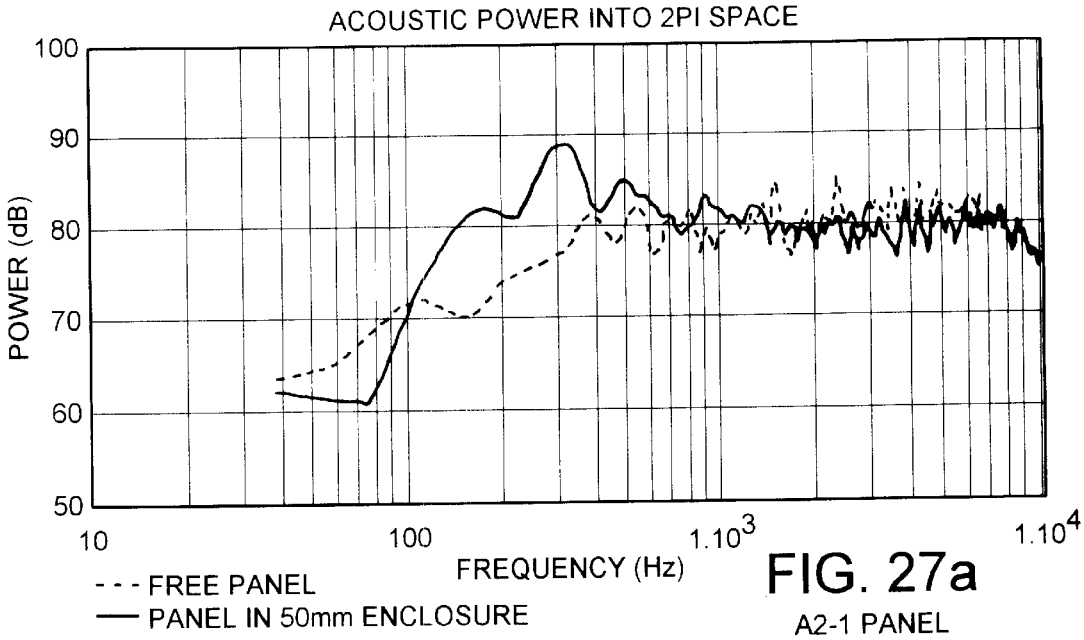
FIG. 27 shows the power response of an A2 panel in an enclosure of two depths.
Figure 27B:
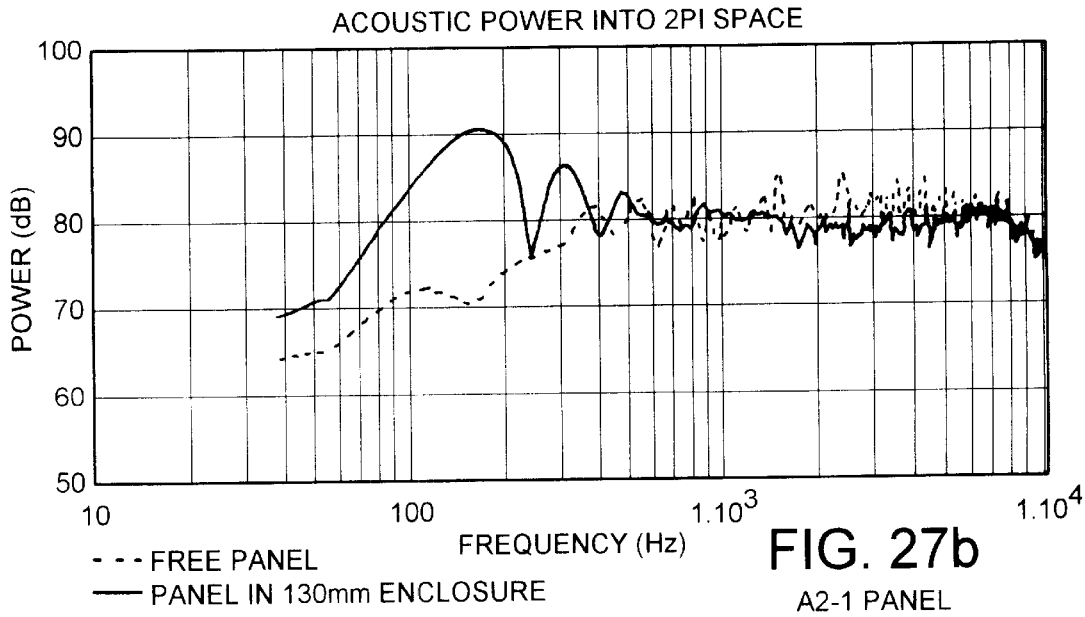

From this data, a contour plot was created to show the pressure distribution at system resonance and that either side of this frequency as shown in FIGS. 22*a* to *c*. The pressure frequency response was also plotted for the nine positions as shown in FIG. 27. This graph exhibits good definition in the region of resonance for all curves associated with the measurement points within the enclosure. However, the pressure tends to vary across the enclosure cross-sectional area as the frequency is increased.

The normal component of velocity and displacement across the panels was measured with a Scanning Laser Vibrometer. The velocity and displacement distribution across the panels were plotted to investigate the behaviour of the panel around the coupled system resonance. The results were documented and a number of the cases are shown in FIGS. 24*a* to *d*. These results suggest a timpanic modal behaviour of the panel at resonance, with the whole of the panel moving, albeit at a lesser velocity and displacement as one moves towards the panel edges.

In practice this behaviour is consistent for all boundary conditions of the panel, although the mode shape will vary from case to case depending on a complex set of parameters, including panel stiffness, mass, size and boundary conditions. In the limit and for an infinitely rigid panel, this system resonance will be seen as the fundamental rigid body mode of the piston acting on the stiffness of the enclosure air volume. It was found to be convenient to call the DML system resonance, the 'Whole Body Mode' or WBM.

The full theoretical derivations of the coupled system has been implemented in a suite of software by New Transducers Limited. A version of this package was used to simulate the mechanoacoustical behaviour of our test objects in this paper. This package is able to take into account all the electrical, mechanical and acoustocal variables associated with a panel, exciter(s) and mechanoacoustical interfaces with a frame or an enclosure and predict, amongst other parameters, the far-field acoustic pressure, power and directivity of the total system.

Figure 25A:
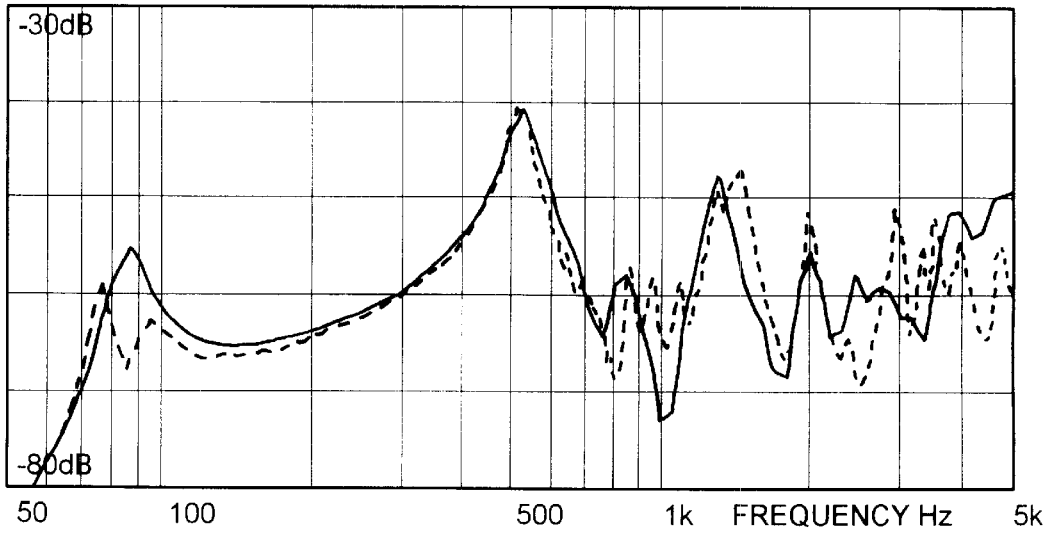
FIG. 25 shows the velocity spectrum of an A5 panel in free space and enclosed.

FIG. 25*a* shows the log-velocity spectrum of a free radiating, A5-1 panel clamped in a frame, radiating in free space equally from both sides. The solid line represents the simulation curve and the dashed line is the measure velocity spectrum. At low frequencies the panel goes in resonance with the exciter. The discrepancy in the frequency range above 1000 Hz is due to the absence of the free field radiation impedance in the simulation model.

Figure 25B:
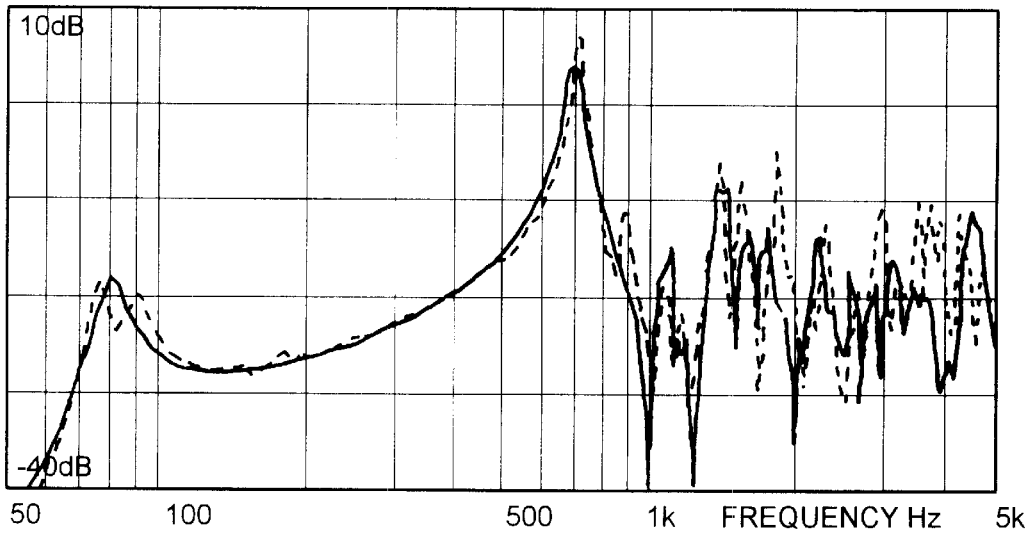

FIG. 25*b* shows the same panel as in FIG. 25*a* but this time loaded with two identical enclosures, one on each side of the panel, with the same cross-section as the panel and a depth of 24 mm. A double enclosure was designed and used in order to exclude the radiation impedance of free field on one side of the panel and make the experiment independent of the free field radiation impedance. It is important to note that this laboratory set-up was used for theory verification only.

Figure 26A:
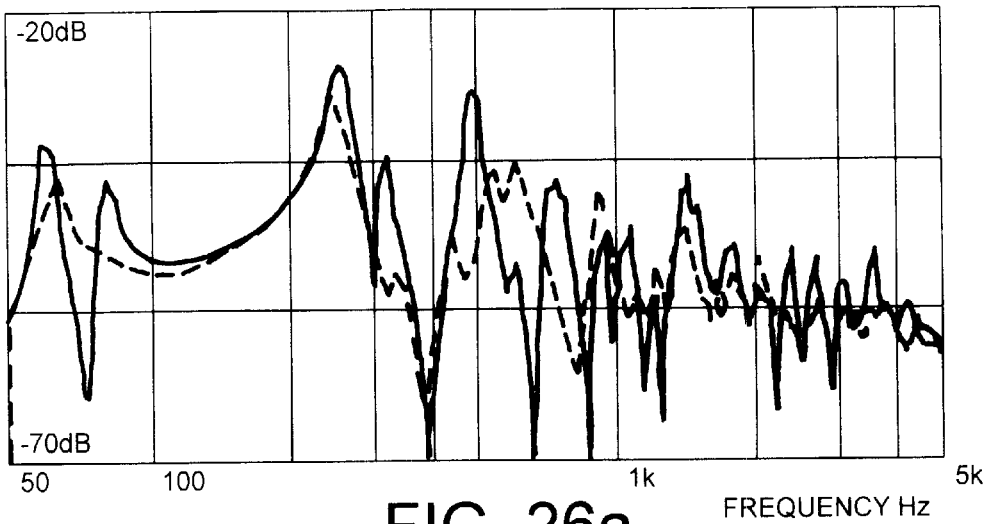
FIG. 26 shows the velocity spectrum of another A5 panel in free space and enclosed.
Figure 26B:
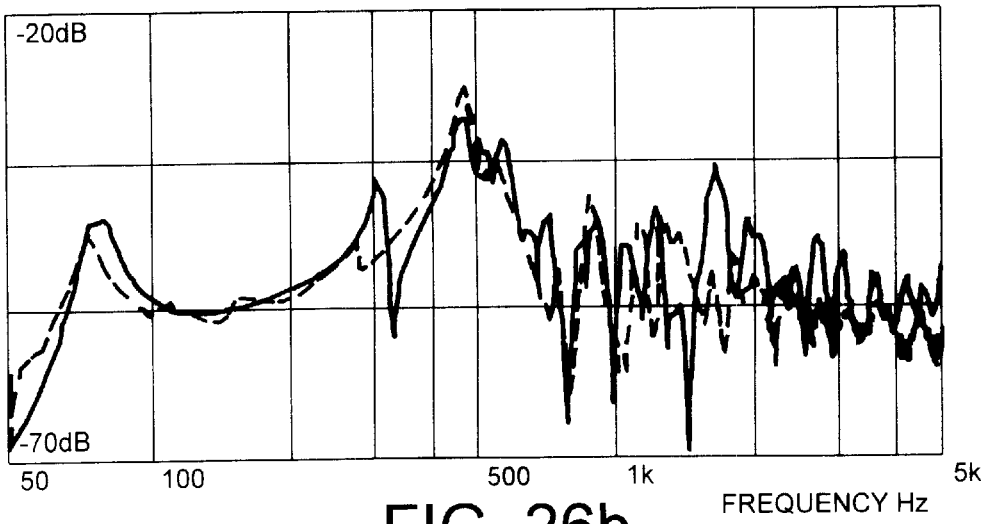

In order to enable velocity measurement of the panel, the back walls of the two enclosures were made from a transparent material to allow access by the laser beam to the panel surface. This test was repeated using panel A5-3 Rohacell without skin, with different bulk properties and the result is shown in FIGS. 26*a* and *b*. In both cases simulation was performed using 200 point logarithmic range, whilst the laser measurement used 1600 point linear range.

From the foregoing theory and work, it is clear that a small enclosure fitted to a DML will bring with it, amongst a number of benefits, a singular drawback. This manifests itself in an excess of power due to WBM at the system resonance as shown in FIGS. 27*a* and *b*. It is noteworthy that apart from this peak, in all other aspect the enclosed DML can offer a substantially improved performance including all increased power bandwidth.

Figure 28A:
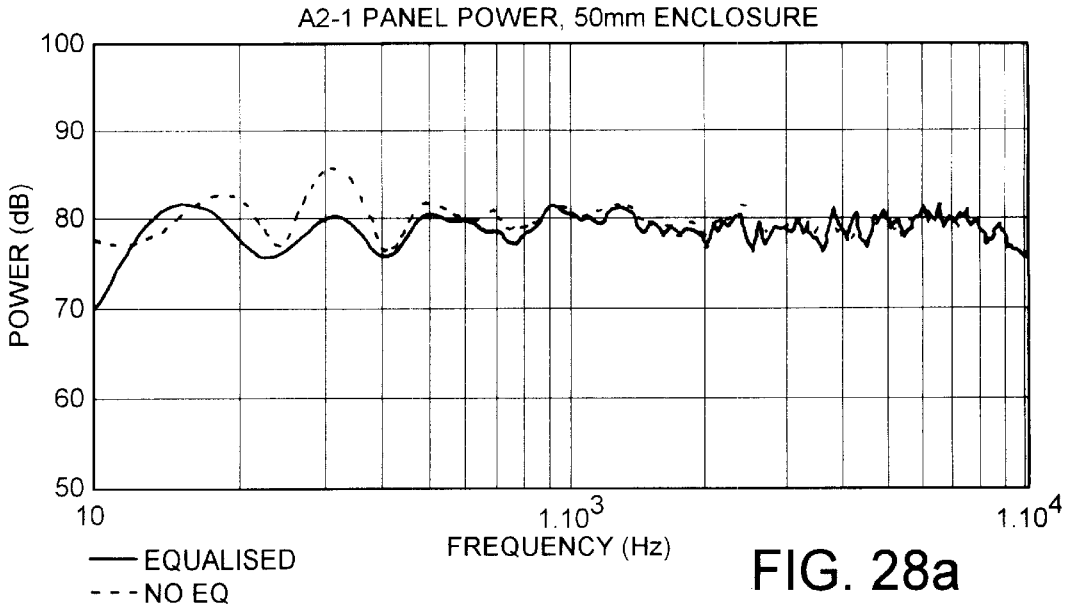
FIG. 28 illustrates equalisation using filters.
Figure 28B:
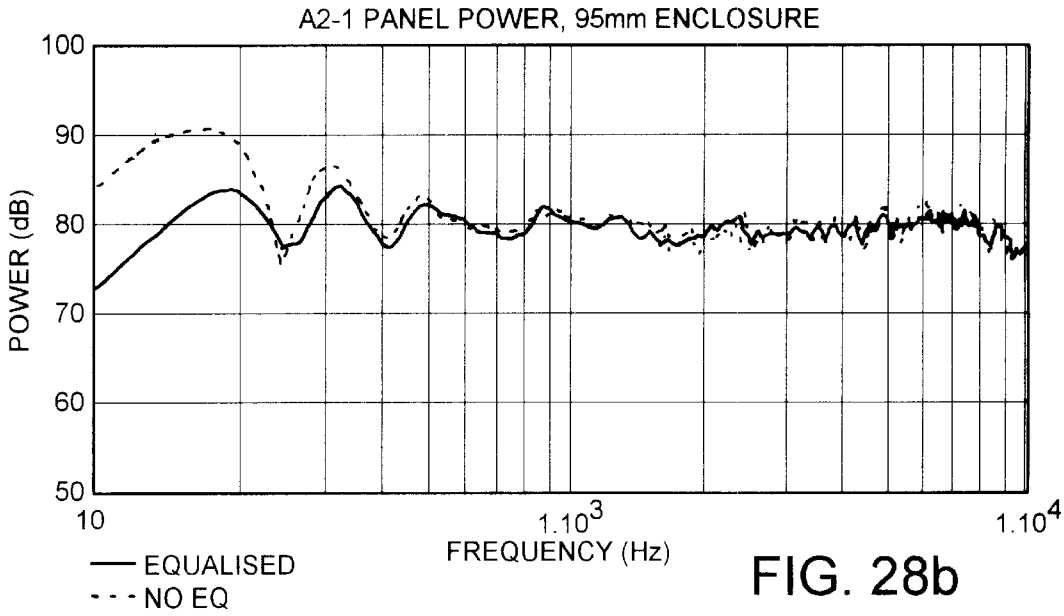
Figure 28C:
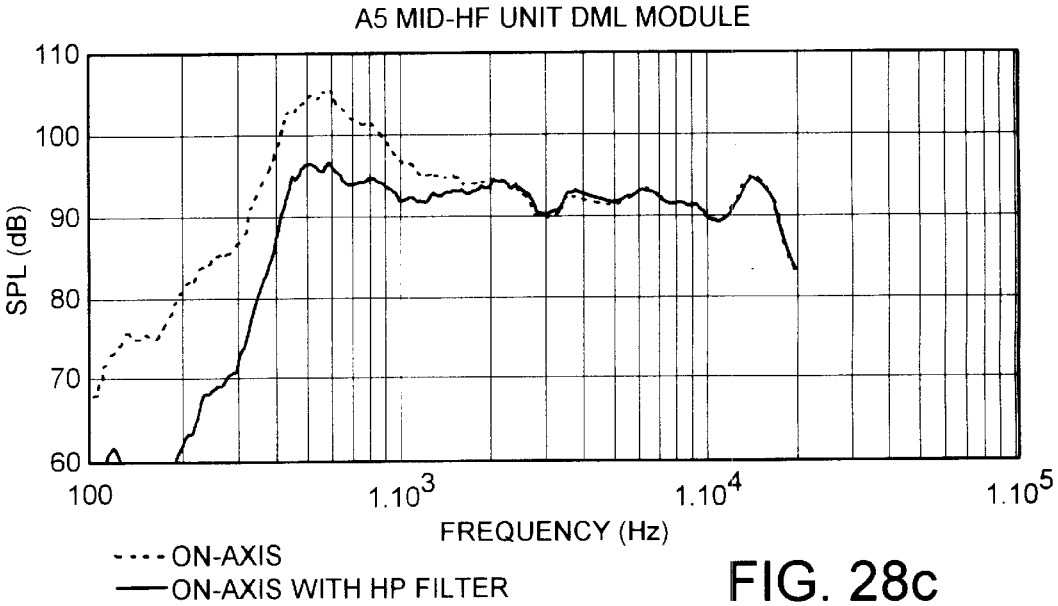

It has been found that in most cases a simple second order band-stop equalisation network of appropriate Q matching that of the power response peak, may be designed to equalise the response peak. Furthermore in some cases a single pole high-pass filter would often adjust for this by tilting the LF region, to provide a broadly flat power response. Due to the unique nature of DML panels and their resistive electrical impedance response, whether the filter is active or passive, its design will remain very simple. FIG. 28*a* shows where a band-stop passive filter has been incorporated for equalisation. Further examples may be seen in FIGS. 28*b* and *c* that shows simple pole EQ as a capacitor used in series with the loudspeakers.

We have shown in this paper that when a free DML is used near and parallel to a wall, special care must be taken to ensure minimal interaction with the latter, due to its unique complex dipolar characteristics. This interaction is a function of the distance to the boundary, and therefore, cannot be universally fixed. Full baffling of the panel has definite advantages in extending the low frequency response of the system, however, this may not be a practical proposition in a large number of applications.

It has also been shown that a very small enclosure used with a DML will render it independent of its immediate environment and make the system predictable in its acoustical performance. The mathematical model developed demonstrates the level of complexity for a DML in the coupled system. This throws a sharp contrast between the prediction and design of a DML and that of the conventional piston radiator. It is quite clear from this work that whilst the mechanoacoustical properties of a cone-in-box may be found by relatively simply calculations (even by a hand calculator) those associated with a DML and its enclosure are subject to complex interactive relationships which render this system impossible to predict without the proper tools.

It is observed that the change in system performance with varying enclosure volume is quite marked in the case where the depth is small compared with the panel dimensions. However, it is also seen that beyond a certain depth the increase in LF response become marginal. This of course is consistent with behaviour of a rigid piston in an enclosure. As an example, an A2 size panel with 50 mm enclosure depth can be designed to have a bandwidth extending down to about 120 Hz, FIG. 24.

Another feature of a DML with a small enclosure is seen to be a significant improvement in the mid and high frequency response of the system. This is in many of the measured and simulated graphs in this paper and of course anticipated by the theory. It is clear that the increase in the panel system modality is mostly responsible for this improvement, however, enclosure losses might also influence this by increasing the overall damping of the system.

Figure 17B:
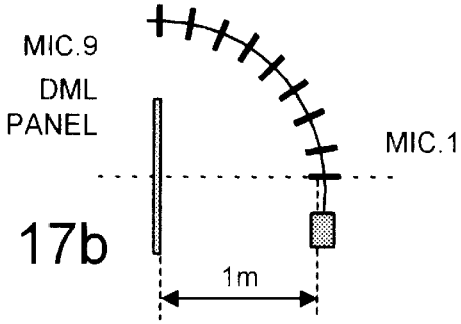

As a natural consequence of containing the rear radiation of the panel, the directivity of the enclosed system changes substantially from a dipolar shape to a near cardioid behaviour as shown in FIG. 17. It is envisaged that the directivity associated with a closed-back DML may find use in certain applications where stronger lateral coverage is desirable.

Power response measurements were found to be most useful when working with the enclosed DM system, in order to observe the excessive energy region that may need compensation. This is in line with other work done on DM loudspeakers, in which it has been found that the power response is the most representative acoustic measurement correlating well to the subjective performance of a DML. Using the power response, it was found that in practice a simple band-pass or a single pole high-pass filter is all that is needed to equalise the power response in this region.

It is noteworthy that the various tests that were undertaken here have shown good levels of correlation to one another in identifying the whole-body-mode of the system and its underlying characteristics.

What is claimed is:

1. An acoustic device comprising a resonant bending wave acoustic panel having opposed faces, the panel having selected values of certain physical parameters which enable the member to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so as to reduce clusterings and disparities of spacings of said frequencies, means defining a fluid-filled cavity enclosing at least a portion of one panel face and arranged to contain acoustic radiation from said portion of said one panel face, wherein the cavity has a rear cavity face facing said one panel face, said rear cavity face being sufficiently stiff and close to said one panel face to cause fluid coupling to the panel such that X and Y cross modes in the fluid are generally dominant, thereby obtaining a more even distribution of resonant modes.

2. An acoustic device according to claim 1, wherein the cavity is sealed.

3. An acoustic device according to claim 1, wherein the ratio of the cavity volume to panel area (ml:cm$^2$) is in the range of about 10:1 to 0.2:1.

4. An acoustic device according to claim 1, wherein the panel is mounted in and sealed to the cavity defining means by a peripheral surround.

5. An acoustic device according to claim 4, wherein the surround is resilient.

6. A loudspeaker comprising an acoustic device as claimed in claim 1 or claim 5, and having a vibration exciter arranged to apply bending wave vibration to the resonant panel to produce an acoustic output.

7. A method of modifying the modal behaviour of a resonant bending wave panel acoustic device, the panel having selected values of certain physical parameters which enable the member to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so as to reduce clusterings and disparities of spacings of said frequencies, the method comprising bringing the resonant panel into close proximity with a boundary surface to define a resonant, fluid-filled cavity therebetween, the boundary surface being sufficiently stiff and close to the resonant panel such that X and Y cross modes in the fluid are generally dominant, thereby obtaining a more even distribution of resonant modes.

* * * * *